US010259553B2

(12) United States Patent
Dow et al.

(10) Patent No.: US 10,259,553 B2
(45) Date of Patent: Apr. 16, 2019

(54) PROPULSION DEVICE FOR WATERCRAFT

(71) Applicant: Hobie Cat Company, a Missouri corporation, Oceanside, CA (US)

(72) Inventors: Philip James Dow, Oceanside, CA (US); Gregory Scott Ketterman, Carlsbad, CA (US); James Taylor Czarnowski, Fallbrook, CA (US); Jason Christopher Kardas, Oceanside, CA (US); Drew William Brackett, Carlsbad, CA (US); Shane Yellin, Carlsbad, CA (US); John Thomas Myers, III, Sacramento, CA (US)

(73) Assignee: Hobie Cat Company, Oceanside, CA (US)

( * ) Notice: Subject to any disclaimer, the term of this patent is extended or adjusted under 35 U.S.C. 154(b) by 0 days.

(21) Appl. No.: 15/683,287

(22) Filed: Aug. 22, 2017

(65) Prior Publication Data

US 2019/0061895 A1 Feb. 28, 2019

(51) Int. Cl.

| | |
|---|---|
| ***B63H 1/36*** | (2006.01) |
| ***B63H 16/04*** | (2006.01) |
| ***B63H 16/20*** | (2006.01) |
| ***B63B 35/71*** | (2006.01) |

(52) U.S. Cl.

CPC ..... *B63H 16/04* (2013.01); *B63B 35/71* (2013.01); *B63H 16/20* (2013.01); *B63B 2035/715* (2013.01)

(58) Field of Classification Search

CPC ..... B63H 16/00; B63H 16/04; B63H 16/12; B63H 16/18; B63H 16/20; B63B 2016/00; B63B 2016/04; B63B 2016/08; B63B 2016/085; B63B 2016/18; B63B 2016/20; B63B 2016/202; B63B 35/71; B63B 2035/71; B63B 2035/715

USPC .... 440/13–21, 26, 27, 31, 32; 114/343, 347, 114/364

See application file for complete search history.

(56) References Cited

U.S. PATENT DOCUMENTS

| | | | |
|---|---|---|---|
| 2,003,934 | A | 6/1935 | Hansel |
| 2,286,914 | A | 6/1942 | Knapp |
| 2,873,713 | A | 2/1959 | Baastrup |
| 2,948,255 | A | 8/1960 | Sbrana |
| 3,695,211 | A | 10/1972 | Gross |
| 3,986,473 | A | 10/1976 | Truzzi |

(Continued)

FOREIGN PATENT DOCUMENTS

| | | |
|---|---|---|
| GB | 452719 | 8/1936 |
| JP | 52-033290 | 3/1977 |

(Continued)

*Primary Examiner* — Daniel V Venne
(74) *Attorney, Agent, or Firm* — Joseph E. Mueth, Esq.

(57) ABSTRACT

A watercraft having a propulsion mechanism extending through an opening in the bottom of the watercraft having a propulsion mechanism adapted to be inserted in an opening in the bottom of a watercraft comprising a pair of pedals each coupled to a flexible fin extending below the water line, the pair of fins oscillate through an arcuate path on a horizontal axis to propel the watercraft. The horizontal axis is preferably continuously rotatable in either direction through 360° on a vertical axis disposed at a substantially right angle to the longitudinal axis of the watercraft to propel the watercraft in any direction.

17 Claims, 66 Drawing Sheets

(56) References Cited

U.S. PATENT DOCUMENTS

| | | | | |
|---|---|---|---|---|
| 4,427,392 | A | 1/1984 | Schneider | |
| 4,490,119 | A | 12/1984 | Young | |
| 4,936,802 | A | 6/1990 | Ueno | |
| 4,960,396 | A | 10/1990 | Stolzer | |
| 5,460,551 | A | 10/1995 | Beres | |
| 6,022,249 | A | 2/2000 | Ketterman | |
| 7,637,791 | B2 | 12/2009 | Ketterman | |
| 9,359,052 | B2 | 6/2016 | Ketterman | |
| 9,981,726 | B2 * | 5/2018 | Ketterman | B63H 1/36 |
| 2007/0032144 | A1 * | 2/2007 | Ketterman | B63H 1/36<br>440/17 |
| 2014/0134901 | A1 * | 5/2014 | Ketterman | B63H 16/12<br>440/14 |
| 2015/0011134 | A1 * | 1/2015 | Czarnowski | B63H 1/36<br>440/14 |
| 2017/0021904 | A1 * | 1/2017 | Ketterman | B63B 35/79 |

FOREIGN PATENT DOCUMENTS

| | | |
|---|---|---|
| JP | 01-144198 | 10/1989 |
| JP | 03-035897 | 4/1991 |

* cited by examiner

PROPULSION DEVICE FOR WATERCRAFT

FIELD OF INVENTION

This invention relates to novel propulsion means for a watercraft using oscillating foils with ability to provide thrust in any direction.

BACKGROUND OF INVENTION

Oscillating fin propulsion has been used to produce efficient propulsion. This technology appears in U.S. Pat. No. 6,022,249, the text and drawings of which are expressly incorporated herein by reference, which discloses a self-propelled watercraft, such as a kayak, which typically include a hull with a keel, having propulsion means extending below the water line. The propulsion means comprises a pair of fins each having a leading edge and a trailing edge and adapted to oscillate through an arcuate path in a generally transverse direction with respect to the central longitudinal dimension of the watercraft. Foot operated pedals worked from the cockpit are operatively associated with the propulsion means for applying input force to the propulsion means. The propulsion means includes a pair of fins which twist to form an angle of attack for providing forward thrust with respect to the longitudinal dimension of the watercraft while moving in both directions along the arcuate path.

U.S. Pat. No. 9,359,052, the disclosure of which is expressly incorporated herein by reference, also discloses a self-propelled watercraft having propulsion means extending below the water line comprising a pair of flexible fins each rotatable on a substantially horizontal axis and each being adapted to oscillate through an arcuate path in a generally transverse direction with respect to the central longitudinal dimension of the watercraft. Input means are operatively associated with the pair of flexible fins for applying input force to oscillate the pair of flexible fins. An improvement is provided by means for positioning the pair of flexible fins to propel the watercraft forward and to rotate the pair of flexible fins 180° about separate axes which are each disposed at a substantially right angle to the horizontal axis to propel the watercraft aft. When input force is applied, the flexible fins can twist to form an angle of attack for providing forward or aft thrust with respect to the longitudinal dimension of the watercraft while moving the flexible fins in both directions along the arcuate path. However, it is not possible to provide thrust other than in forward or aft directions.

SUMMARY OF THE INVENTION

A propulsion mechanism adapted to be inserted in an opening in the bottom of a watercraft comprising a pair of flexible fins extending below the water line, said pair of flexible fins each adapted to oscillate through an arcuate path on a horizontal axis to propel the watercraft, said horizontal axis being continuously rotatable in either direction about a generally vertical axis to propel said watercraft in any direction, whereby as input force is applied to said pair of flexible fins, said pair of flexible fins twist to form an angle of attack for providing thrust while moving in both directions along said arcuate path.

A watercraft comprising a propulsion mechanism extending through an opening in the bottom of the watercraft, said propulsion mechanism comprising a pair of flexible fins extending below the water line, said pair of flexible fins each adapted to oscillate through an arcuate path on a horizontal axis to propel the watercraft, said horizontal axis being continuously rotatable in either direction about a generally vertical axis to propel said watercraft in any direction, whereby as input force is applied to said pair of flexible fins, said pair of flexible fins can twist to form an angle of attack for providing thrust while moving in both directions along said arcuate path.

A propulsion mechanism adapted to be inserted in an opening in the bottom of a watercraft comprising a pair of flexible fins extending below the water line, said pair of flexible fins each adapted to oscillate through an arcuate path on a horizontal axis to propel the watercraft, said horizontal axis being continuously rotatable in either direction about a generally vertical axis to propel said watercraft in any direction, and a pair of pedals operatively associated with said pair of flexible fins for applying input force whereby as input force is applied, said pair of flexible fins can twist to form an angle of attack for providing thrust while moving in both directions along said arcuate path.

A watercraft comprising a propulsion mechanism extending through an opening in the bottom of the watercraft, said propulsion mechanism comprising a pair of flexible fins extending below the water line, said pair of flexible fins each adapted to oscillate through an arcuate path on a horizontal axis to propel the watercraft, said horizontal axis being continuously rotatable in either direction about a generally vertical axis to propel said watercraft in any direction, and a pair of pedals operatively associated with said pair of flexible fins for applying input force whereby as input force is applied, said pair of flexible fins can twist to form an angle of attack for providing thrust while moving in both directions along said arcuate path.

A propulsion mechanism adapted to be inserted in an opening in the bottom of a watercraft comprising a pair of flexible fins extending below the water line, said pair of flexible fins each adapted to oscillate through an arcuate path on a horizontal axis to propel the watercraft, said horizontal axis being continuously rotatable in either direction about a generally vertical axis to propel said watercraft in any direction, the vertical axis being coupled to elements operable from within the watercraft to steer the watercraft in any direction while being pedaled, and a pair of pedals operatively associated with said pair of flexible fins for applying input force whereby as input force is applied, said pair of flexible fins can twist to form an angle of attack for providing thrust while moving in both directions along the arcuate path.

A watercraft comprising a propulsion mechanism extending through an opening in the bottom of the watercraft, said propulsion mechanism comprising a pair of flexible fins extending below the water line, said pair of flexible fins each adapted to oscillate through an arcuate path on a horizontal axis to propel the watercraft, said horizontal axis being continuously rotatable in either direction about a generally vertical axis to propel said watercraft in any direction, said vertical axis being coupled to elements operable from within the watercraft to steer the watercraft in any direction while being pedaled, and a pair of pedals operatively associated with the pair of flexible fins for applying input force whereby as input force is applied, said pair of flexible fins can twist to form an angle of attack for providing thrust while moving in both directions along the arcuate path.

In another important aspect, this invention comprises a watercraft comprising a propulsion mechanism extending through an opening in the bottom of the watercraft. The propulsion mechanism is adapted to rotate about a generally vertical axis by steering from within the watercraft to rotate the propulsion mechanism in any direction. The watercraft has locking means to prevent the propulsion mechanism from rotating. The locking means are adapted to disengage when the watercraft is steered. A pair of pedals are operatively associated with the propulsion mechanism for applying input force whereby as input force is applied thrust is produced.

A key feature of this invention's design is that the drive can produce thrust in any direction which adds to the maneuverability of the boat. In this invention, the fins are able to rotate as a pair around a single vertical axis. This means the lower section or "lower unit" of the drive comprising the fins is able to be rotated independently of the upper section or "upper unit" comprising the means for applying input force, preferably pedals, allowing the drive to thrust in any direction.

This invention dramatically increases the maneuverability of kayaks, allowing the drive to be used to propel and turn the boat. Optionally, by retaining the rudder, both the drive and the rudder can be used independently to maneuver the boat, further increasing the maneuverability. The lower unit can also be rotated 180 degrees into a reverse position, and then the user can thrust in reverse with the drive and steer with the rudder. The drive can, however, be used as the sole means of propulsion and steering on a watercraft.

The ability to rotate the drive to any direction through 360° is even more beneficial than reverse. It allows the watercraft to rotate about its own axis and move sideways through the water, hold in a location pointing any direction, and provides extremely precise and effective maneuverability.

Another feature of this invention is that an indicator can be placed on top of the device which shows the direction that the watercraft will be thrusted.

This invention uses a four cable transmission system with modifications to allow the rotation of the lower unit. All four cables are redirected to be grouped around and parallel to the vertical axis of the pivot that has been added to the drive. Each set of cables that transmit the force at the same time are located on opposite sides of the vertical axis. Each of the four cables are separated into two lengths of cable, with the break occurring halfway along the vertical length of cable. One set of upper cables is attached to a free-floating horizontal bearing ring. This ring interfaces with another free-floating horizontal bearing ring, with ball bearings between the two rings. This second ring is attached to the lower sections of cable. The second set of upper cables is attached to a smaller horizontal free-floating bearing ring. This ring interfaces with another small free-floating horizontal bearing ring, with ball bearings between flanges on the two rings. This second ring is attached to the lower sections of cable. This smaller horizontal bearing ring assembly is small enough to pass freely inside the larger bearing ring assembly. As input force is applied to the pedals the sections of cable move back and forth, the larger ring bearing moves up and down along the vertical axis. The smaller ring bearing assembly also travels up and down along the vertical axis, in an opposite direction to the larger bearing ring assembly. With each pedal stroke, the smaller ring assembly passes through the larger ring assembly.

These two ring bearing assemblies allow for the lower unit to rotate independently of the upper unit. As the lower unit is pivoted around the vertical axis, the lower bearing rings rotate with the lower cables and lower unit and the upper bearing rings and upper cables do not rotate. The ball bearings between each upper and lower bearing ring allow for free rotation even under high cable tension. The bearing ring assemblies are free to rotate a full 360° at any position along the vertical axis, and can be rotated when the drive is being pedaled or not being pedaled.

Another feature of this invention is the drive steering systems and clutch which allows for the user to control the position of the lower unit of the drive, and therefore the direction of thrust, by operating a steering handle located within arm's reach of the user. This handle rotates around a vertical axis, and the direction the handle is pointing correlates with the direction of thrust from the drive. This handle can be rotated infinitely in either direction. The clutch serves to keep the lower unit fixed while the drive is in use, but to allow the user to turn the lower unit with the handle. Force from the lower unit will not release the clutch. If the lower unit is over forced, as upon hitting a submerged object, there is a built in slip mechanism to allow all parts of the steering system to rotate, including the clutch. This is to avoid high load damaging the clutch or the steering system.

THE DRAWINGS

Turning to the drawings.

DESCRIPTION OF THE PREFERRED EMBODIMENTS

Figure 1:
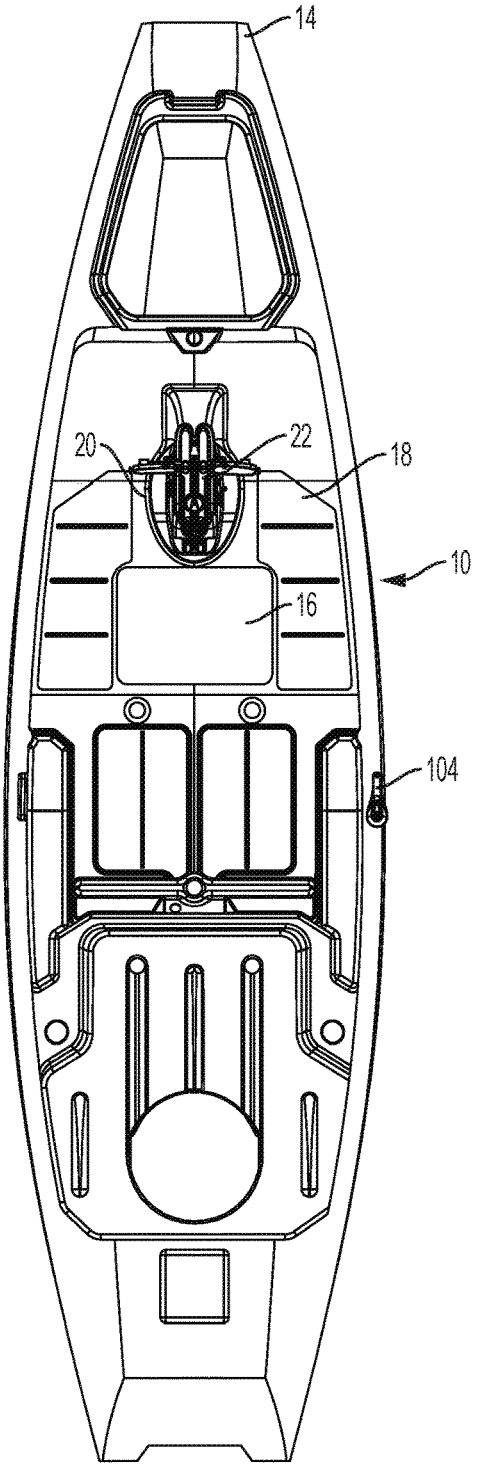
FIG. 1 is a top plan view of a preferred watercraft of this invention showing the upper side of the propulsion mechanism of this invention.
Figure 2:
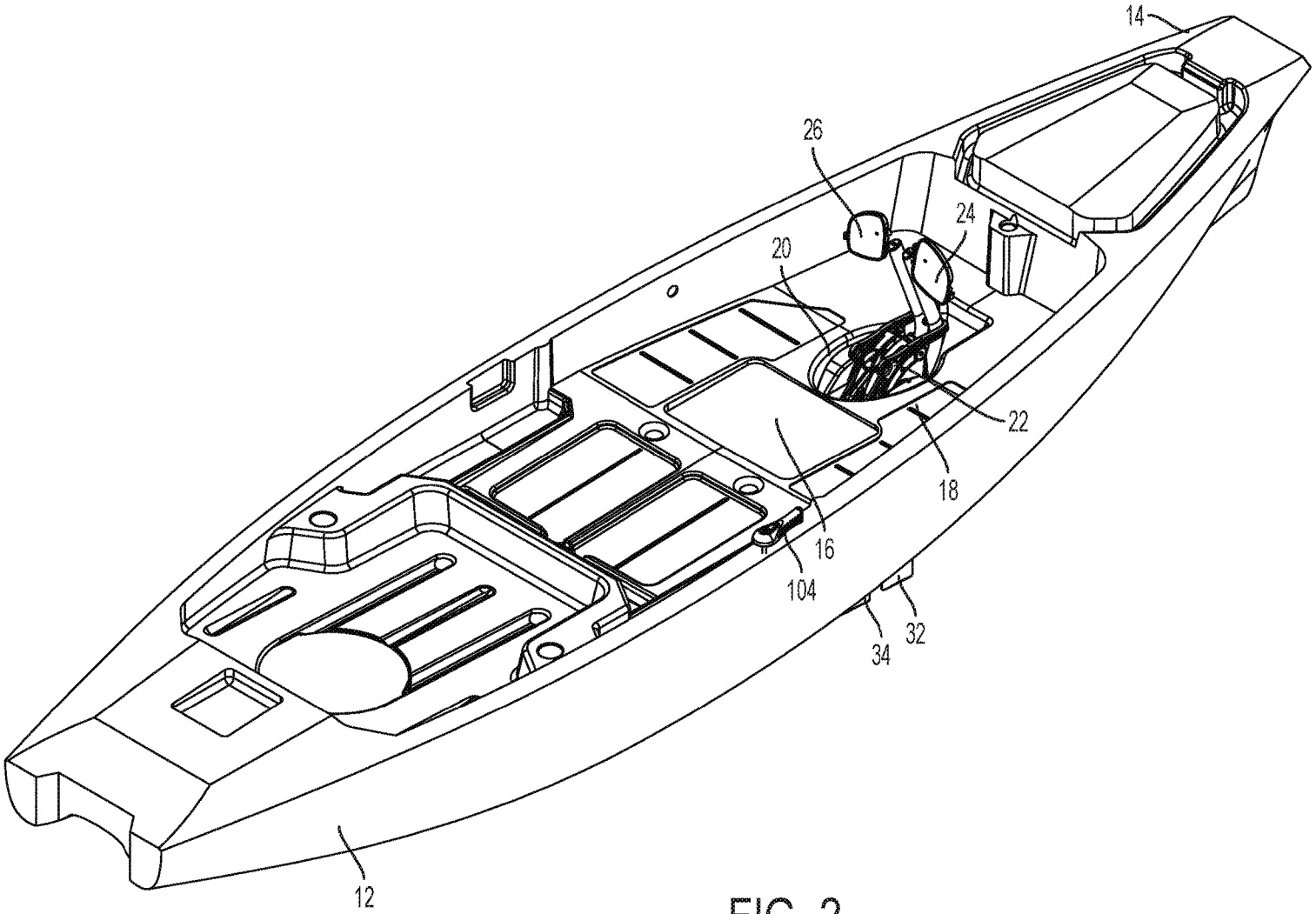
FIG. 2 is a perspective view from the upper rear right of the watercraft of FIG. 1.
Figure 3:
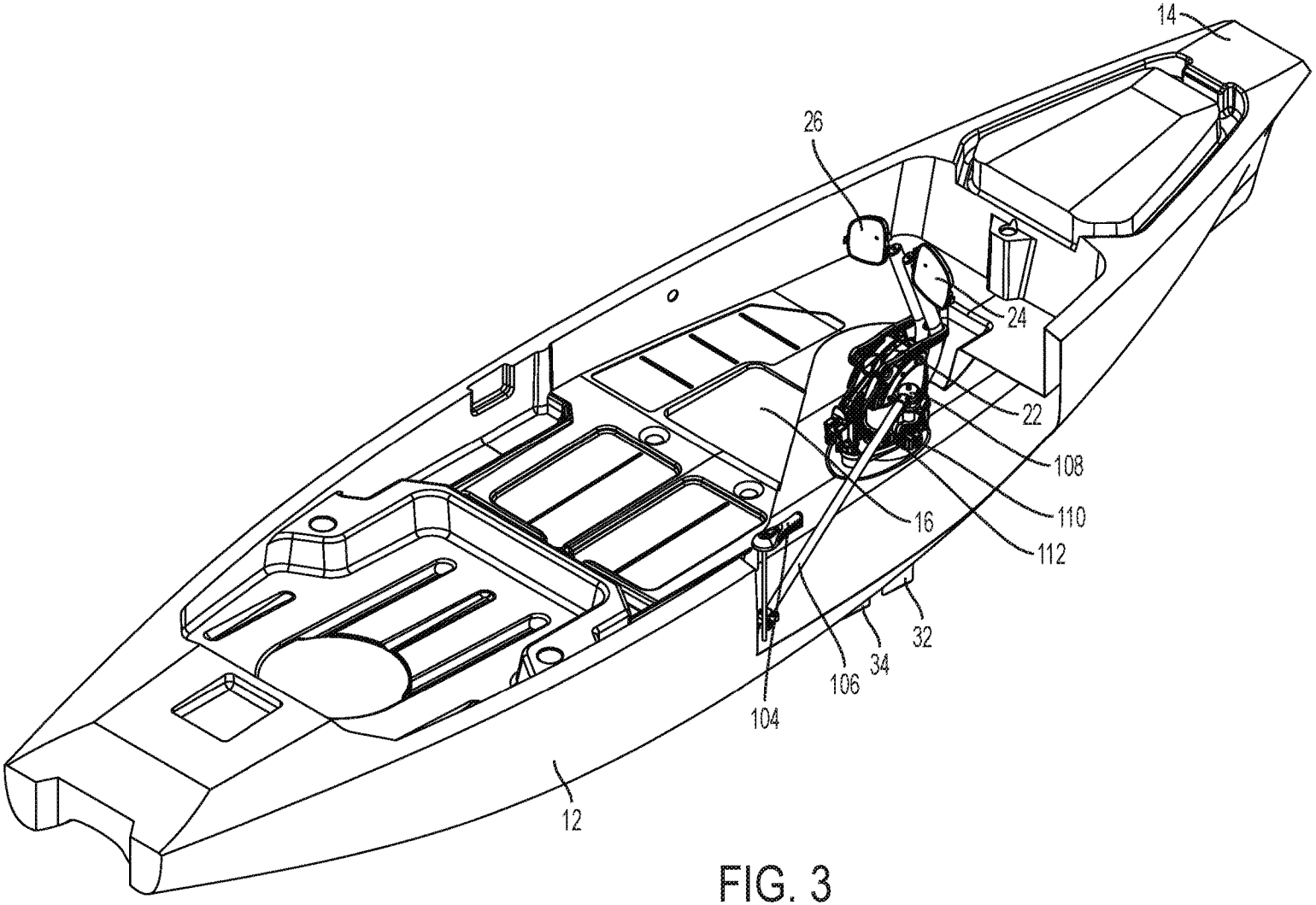
FIG. 3 is similar to FIG. 2 with parts broken away showing the steering handle and connecting rod attached to the propulsion mechanism as well as the propulsion mechanism received in an opening at the bottom of the watercraft.

FIG. 1 shows a preferred watercraft 10 having a hull 12, a bow 14, a cockpit 16 having a floor 18, a through well or opening 20 in which is received the propulsion mechanism 22 of this invention. The pedals 24 and 26, pedal shafts 28 and 30 and fins 32 and 34 all form part of propulsion mechanism 22. The pedals 18 and 20 are operatively connected to pedal shafts 26 and 28.

Figure 4:
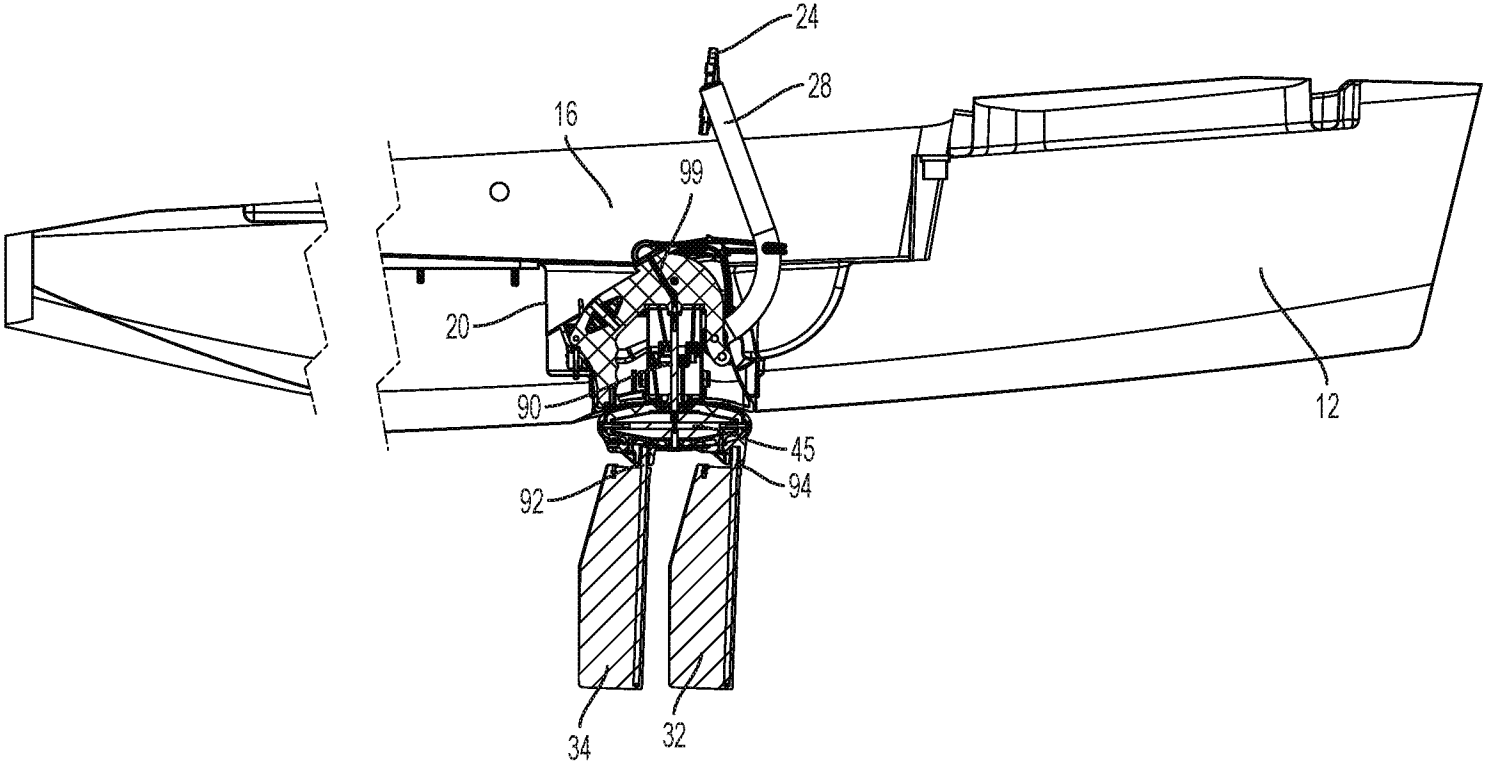
FIG. 4 is a side view showing the propulsion mechanism including the parts broken away to show pedal, pedal shaft and two rotatable drums, each carrying a mast bearing a fin, as well as the steering connecting rod.
Figure 5:
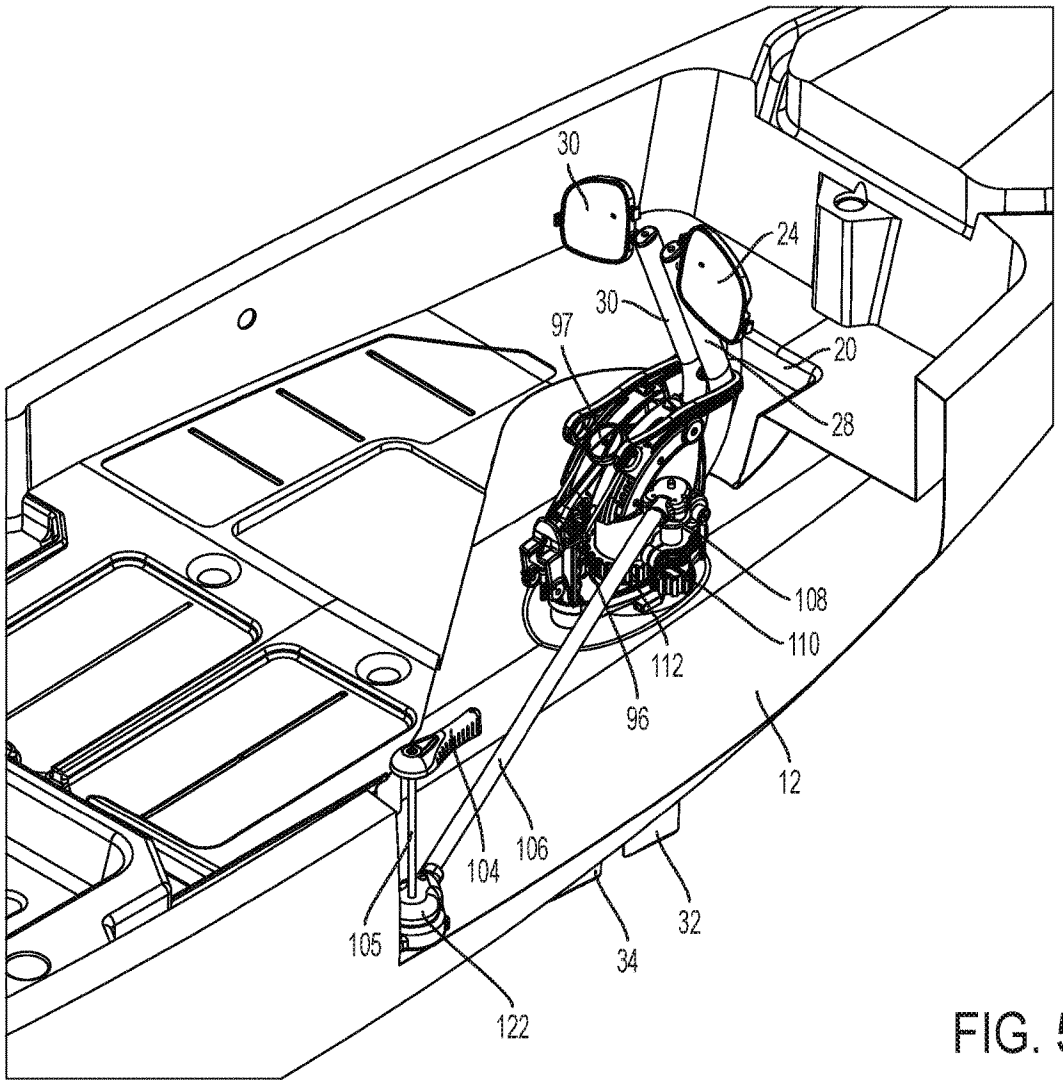
FIG. 5 is similar to FIG. 3, showing more details of the propulsion mechanism with steering elements.
Figure 6:
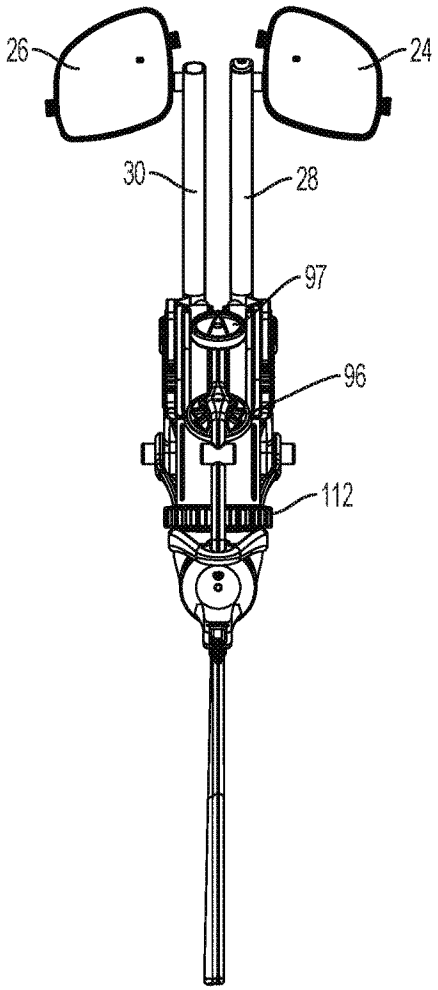
FIG. 6 is a plan view from the rear of the propulsion mechanism of this invention as it appears from the rear when steered in a bow forward position.
Figure 7:
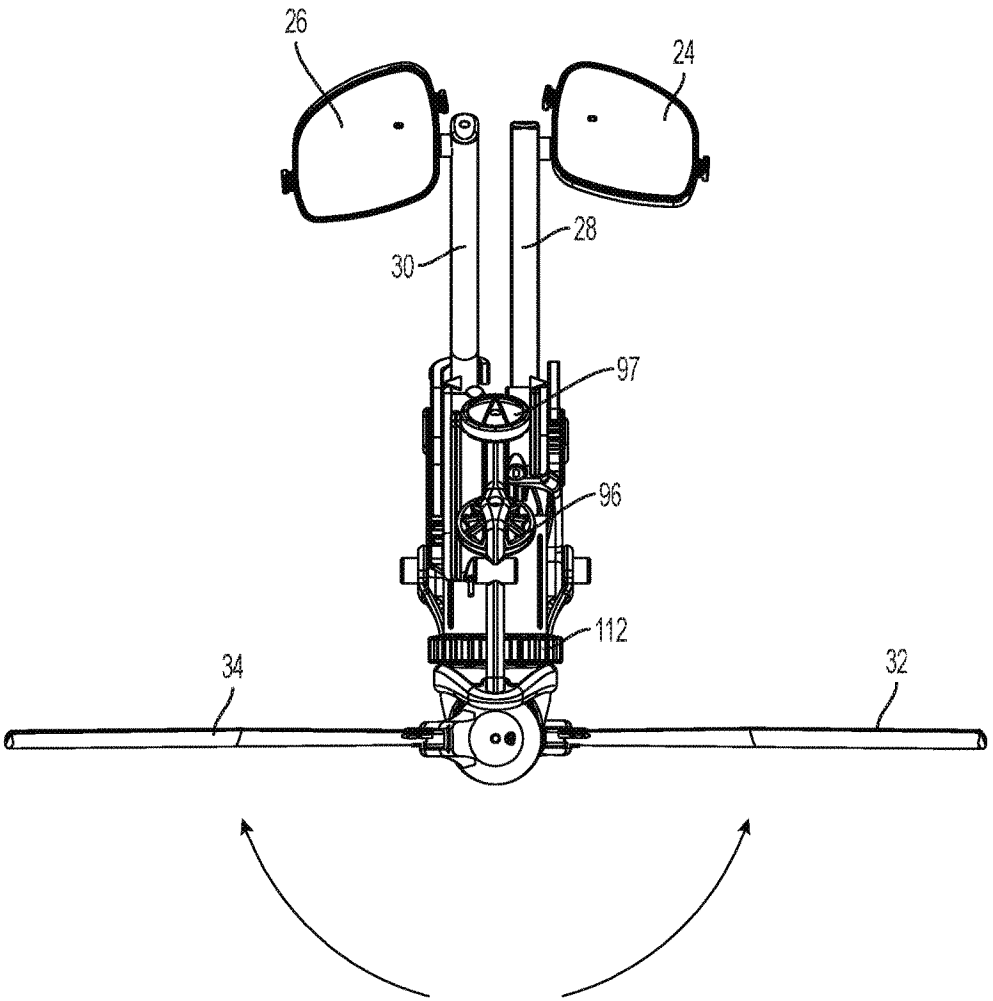
FIG. 7 is similar to FIG. 6 except that the pedals have been operated to cause the drums with fins to rotate, with the right pedal moved forward and the left pedal moved to the rear, thereby causing each of the fins to rotate 90°.
Figure 8:
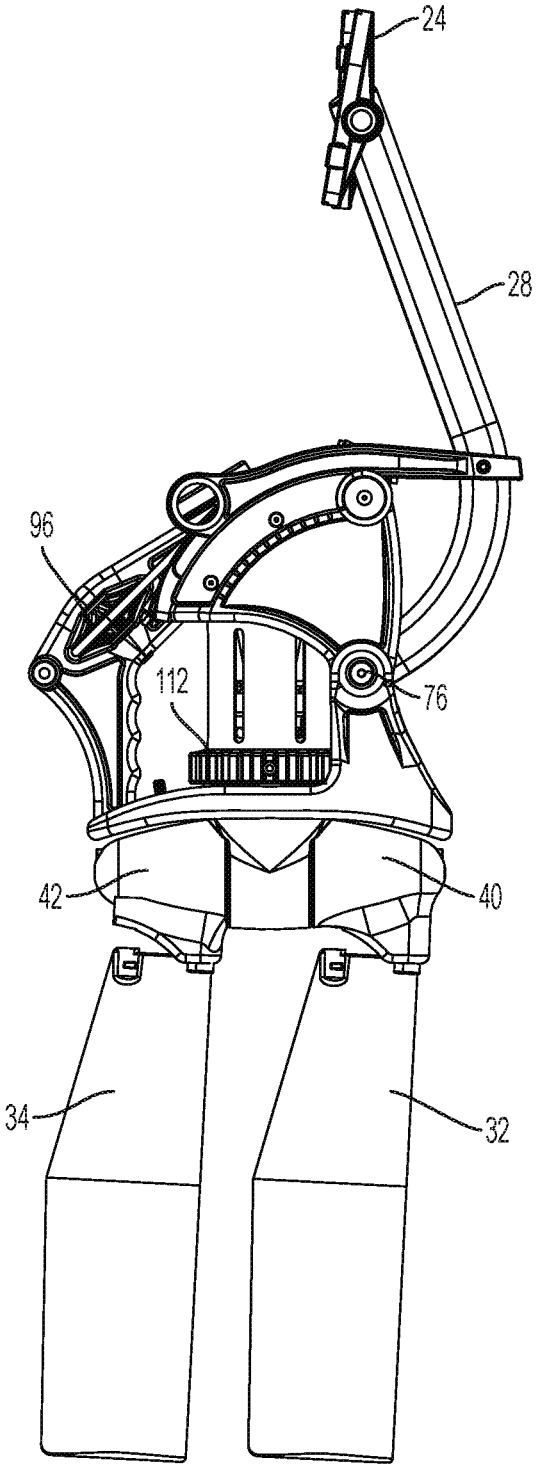
FIG. 8 is a side view of the propulsion mechanism where the pedals are in the position shown in FIG. 6.
Figure 9:
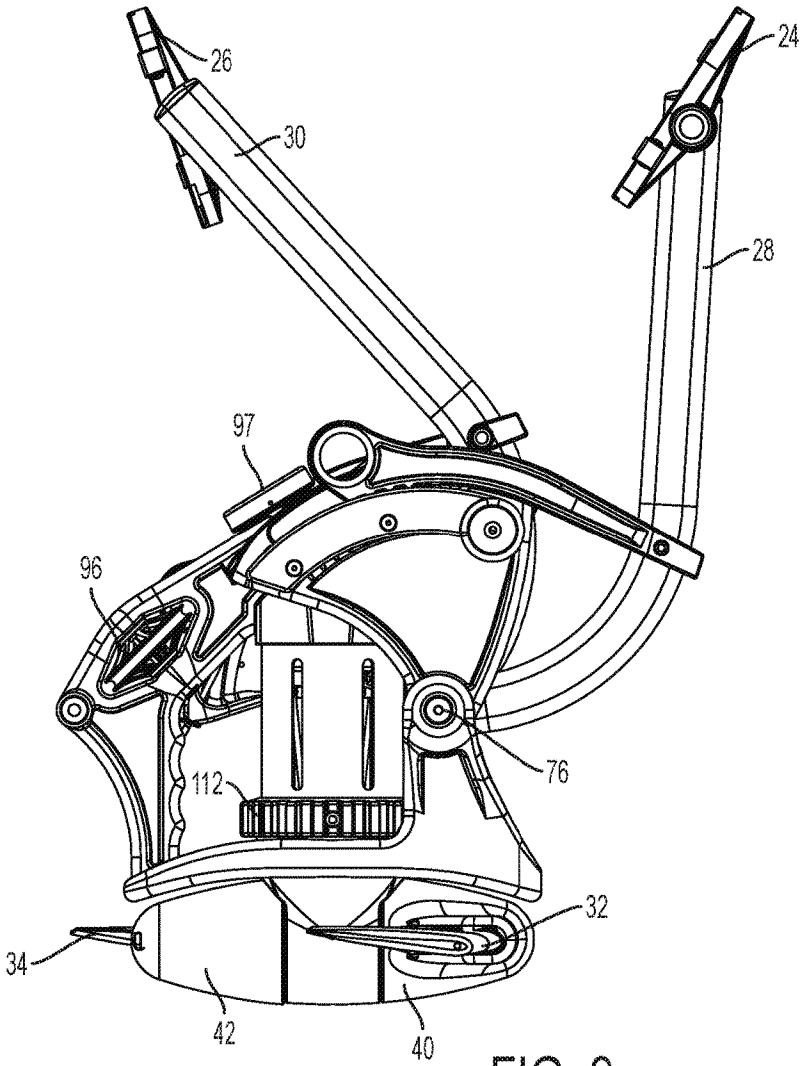
FIG. 9 is a side view of the propulsion system where the pedals are in the position shown in FIG. 7.
Figure 10:
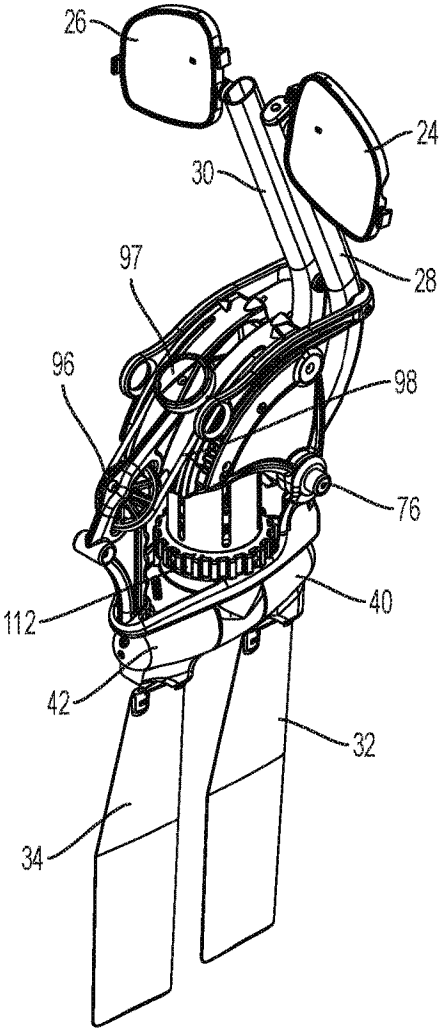
FIG. 10 is a perspective view taken from the right rear showing the propulsion mechanism with the pedals in the position shown in FIG. 6.
Figure 11:
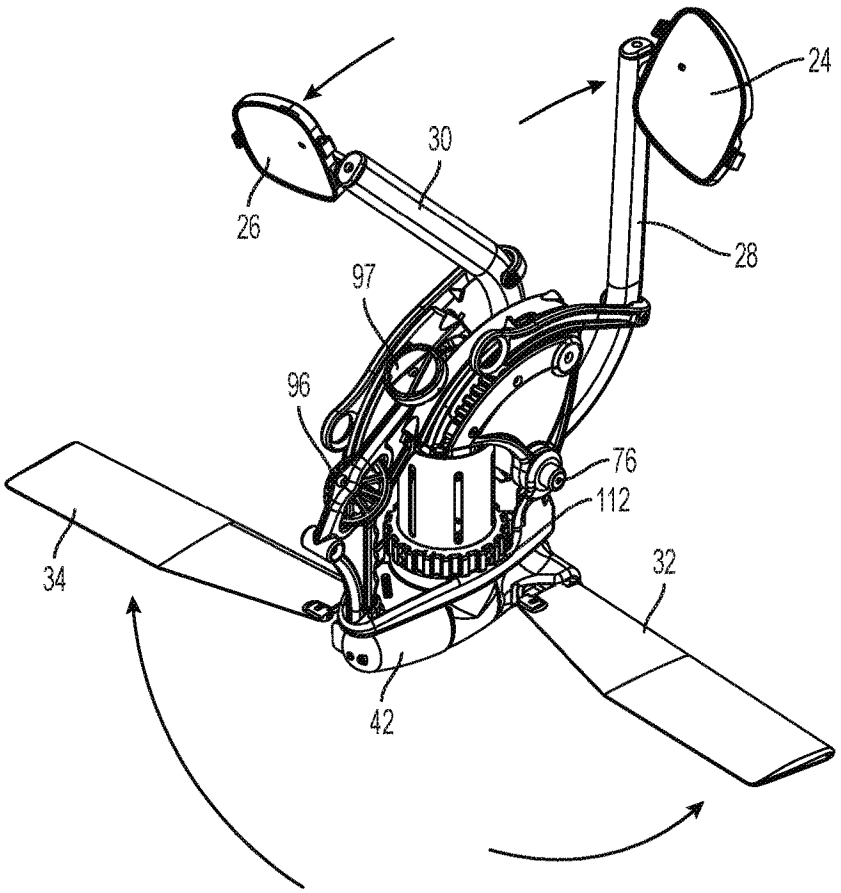
FIG. 11 is similar to FIG. 10 with the pedals in the position shown in FIG. 7.
Figure 12:
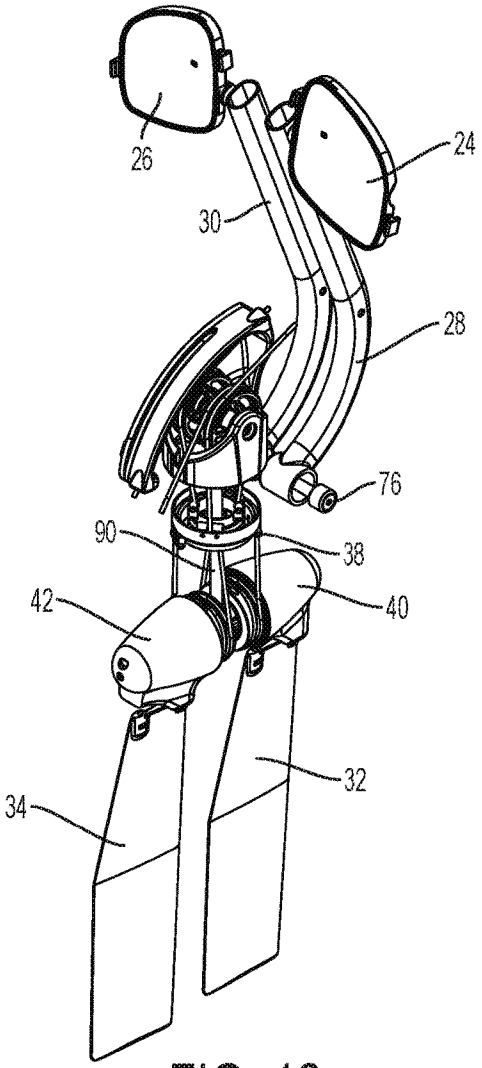
FIG. 12 is similar to FIG. 10 with additional parts broken away to show the cables and nested bearing ring assemblies.
Figure 13:
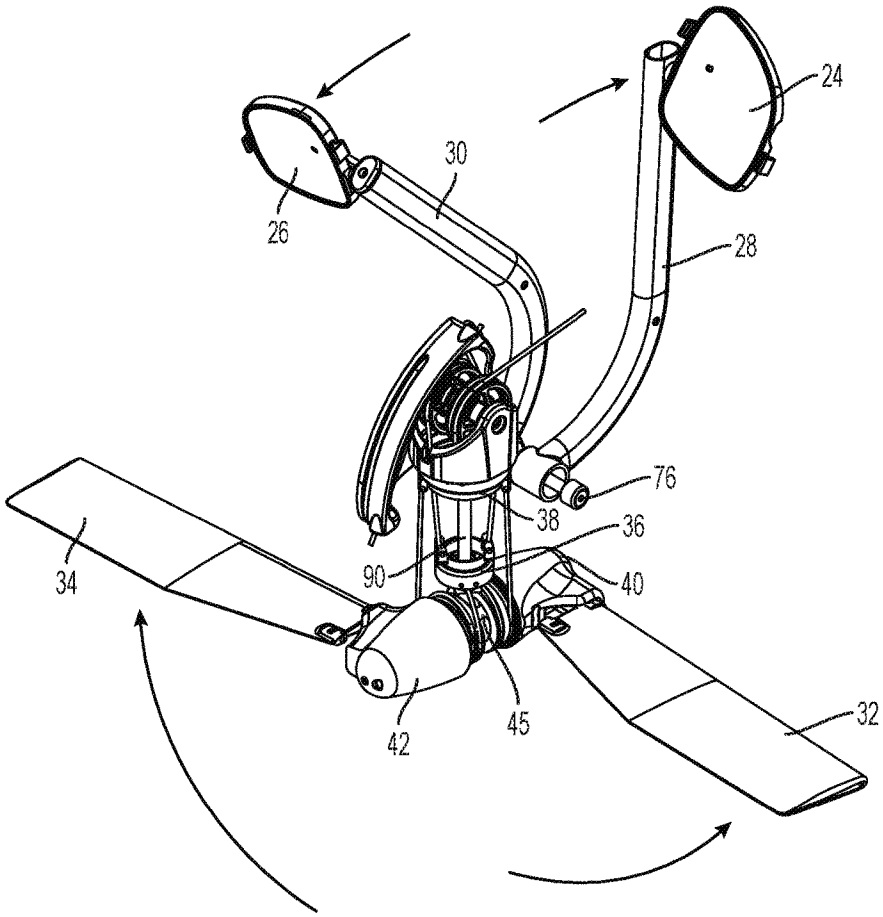
FIG. 13 is similar to FIG. 11 with further parts broken away to show the larger outer and smaller inner bearing ring assemblies are separated to cause the drums carrying the fins to each rotate 90° as indicated by the arrows.
Figure 14:
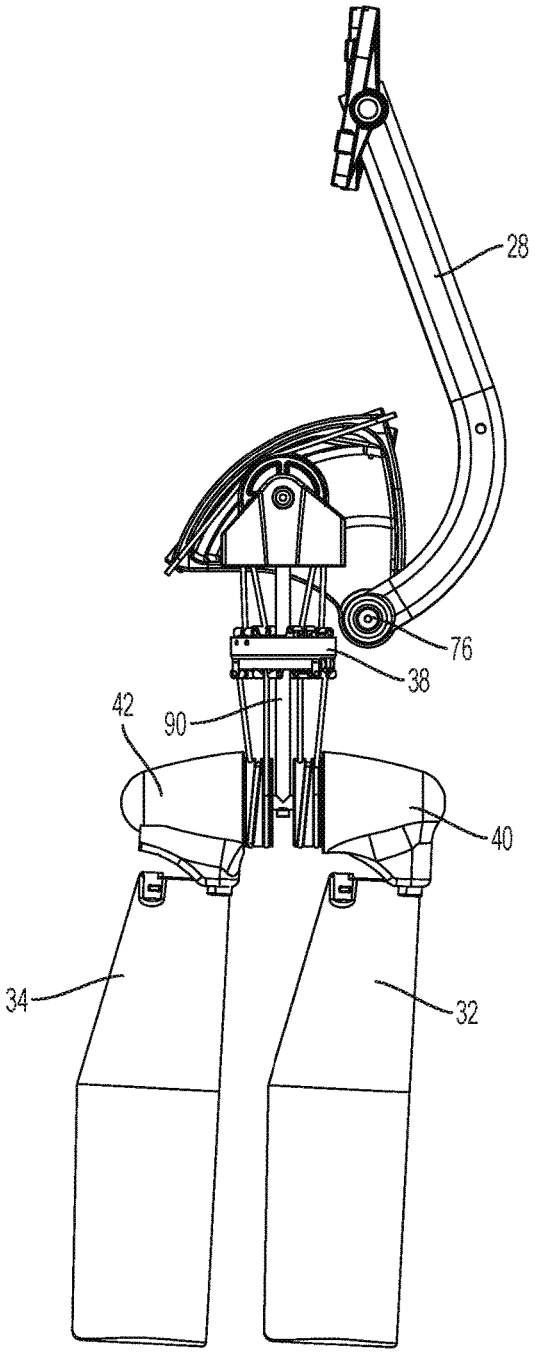
FIG. 14 is a side view of the propulsion mechanism shown in FIG. 12.
Figure 15:
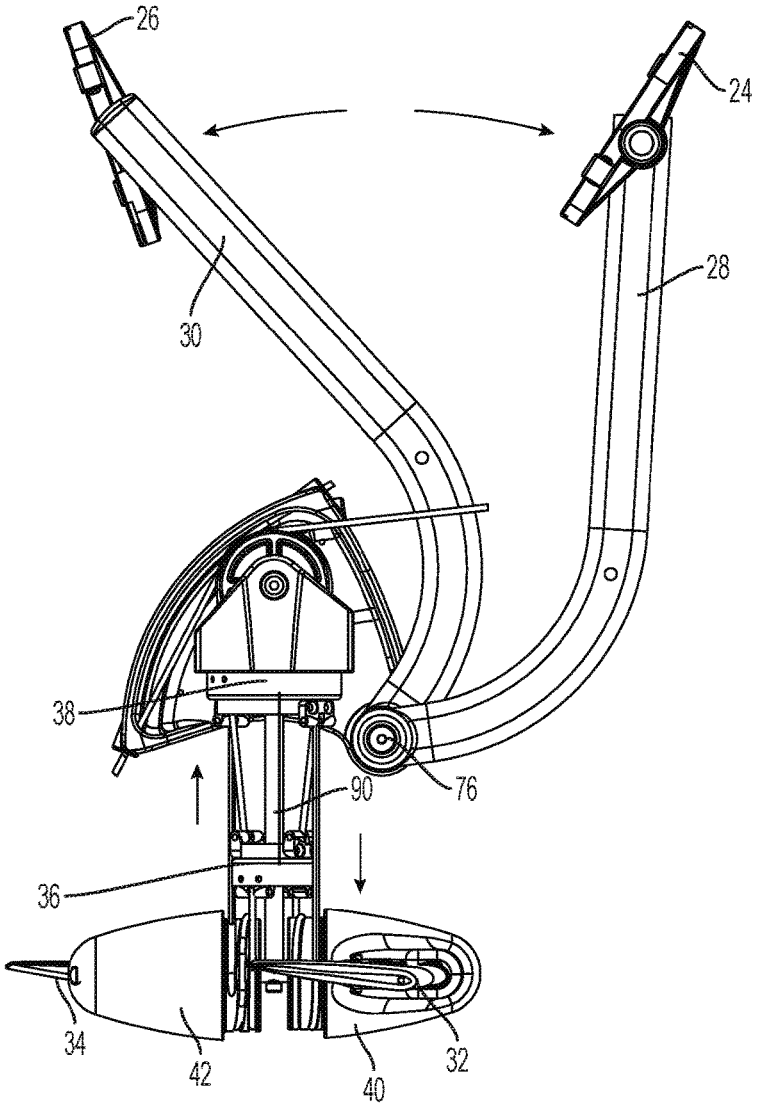
FIG. 15 is a side view of the propulsion mechanism as shown in FIG. 13.
Figure 16:
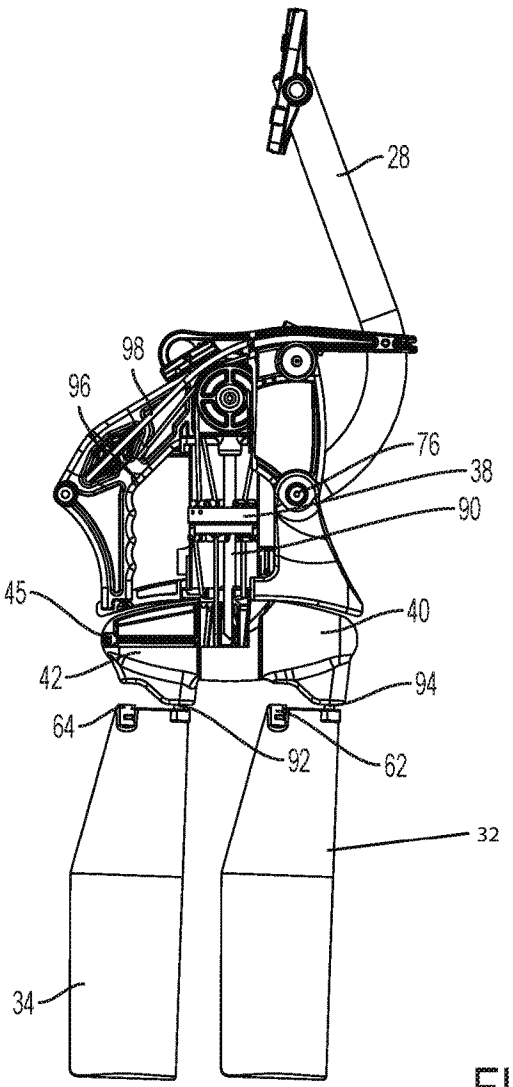
FIG. 16 is similar to FIG. 14 with more parts broken away and added to show more detail.
Figure 17:
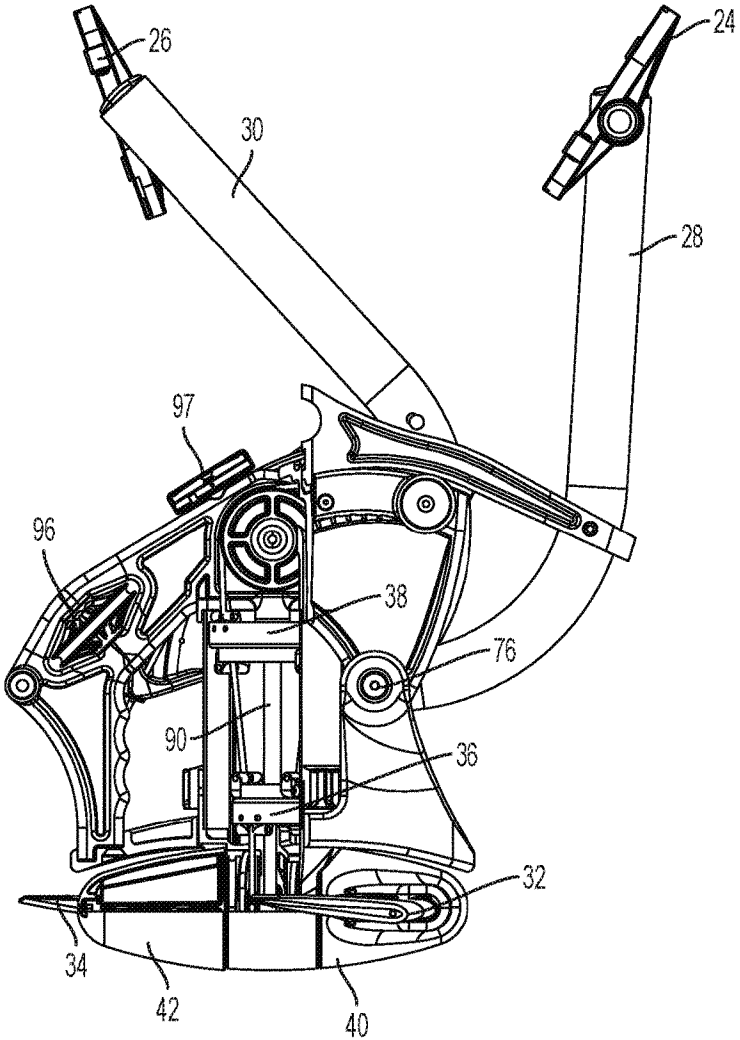
FIG. 17 is similar to FIG. 15 with more parts broken away and added to show more detail.
Figure 18:
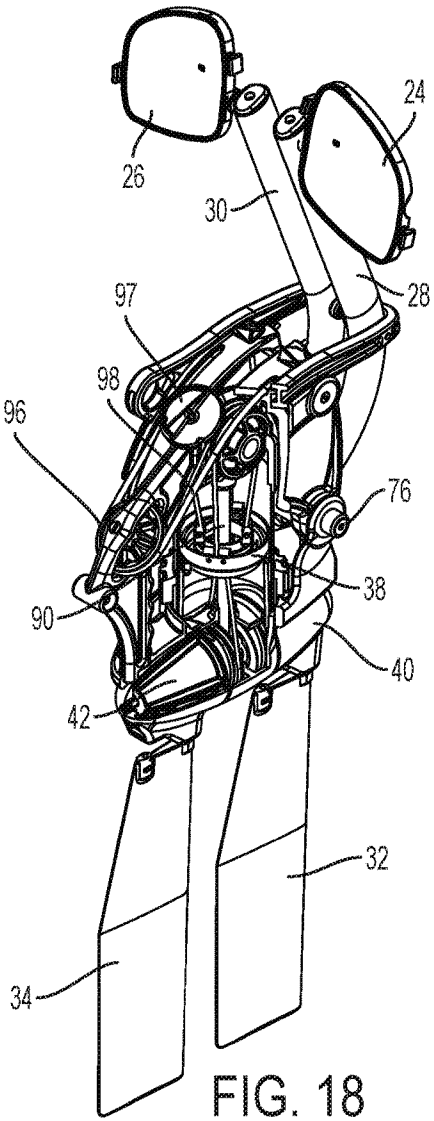
FIG. 18 is a perspective view from the upper rear showing the parts shown in FIG. 16.
Figure 19:
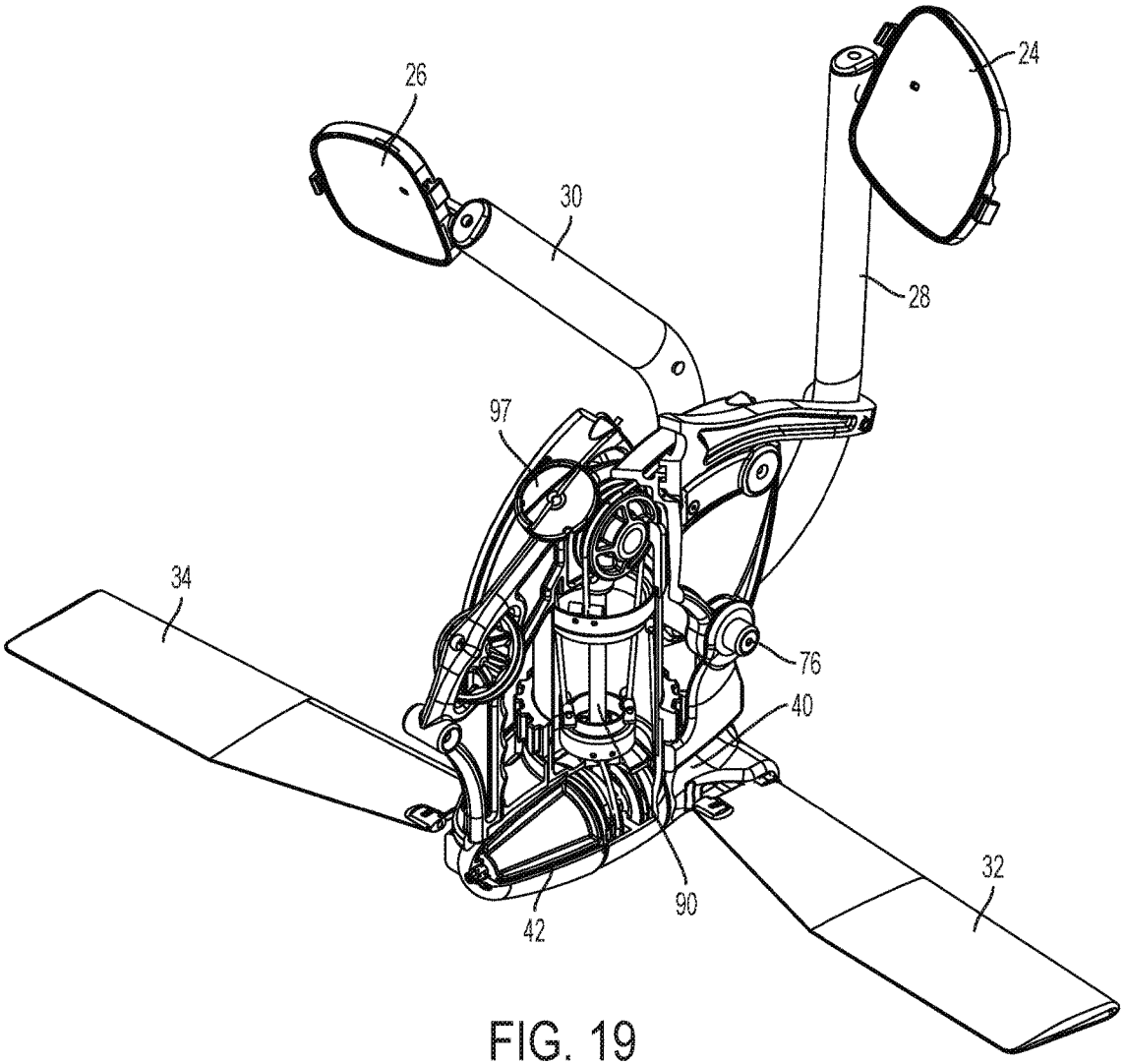
FIG. 19 is a perspective view from the upper rear showing the fins in the position shown in FIG. 17.
Figure 20:
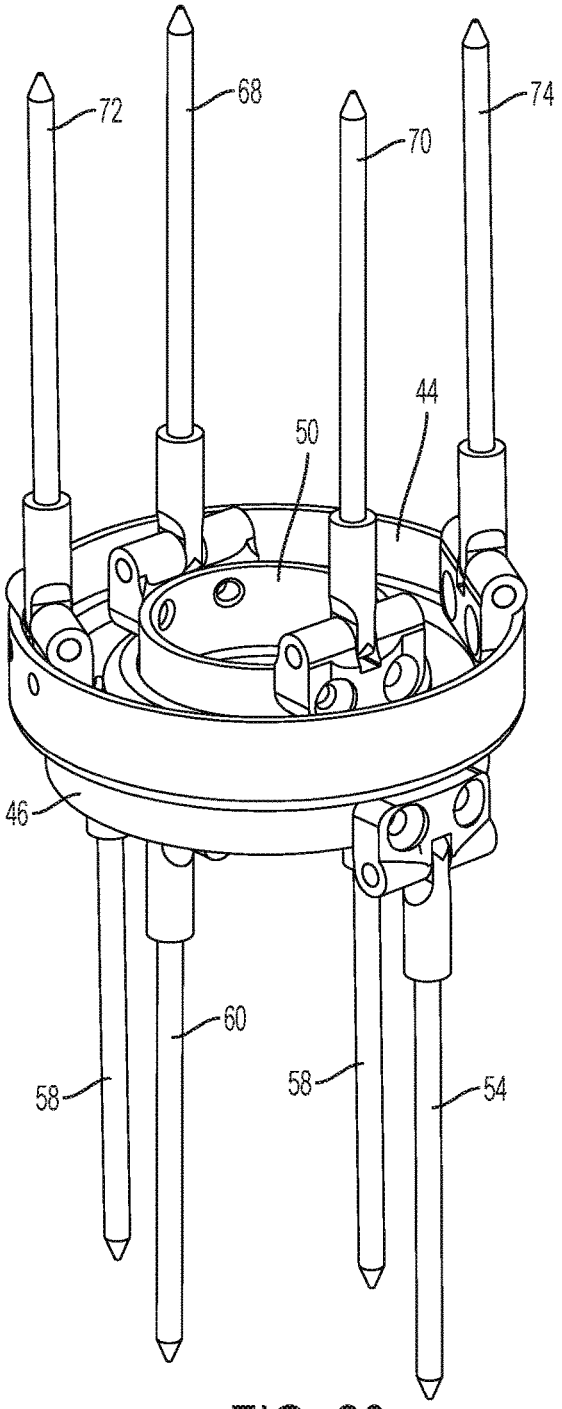
FIG. 20 is a schematic view of the two bearing ring assemblies and cables when the assemblies are nested.
Figure 21:
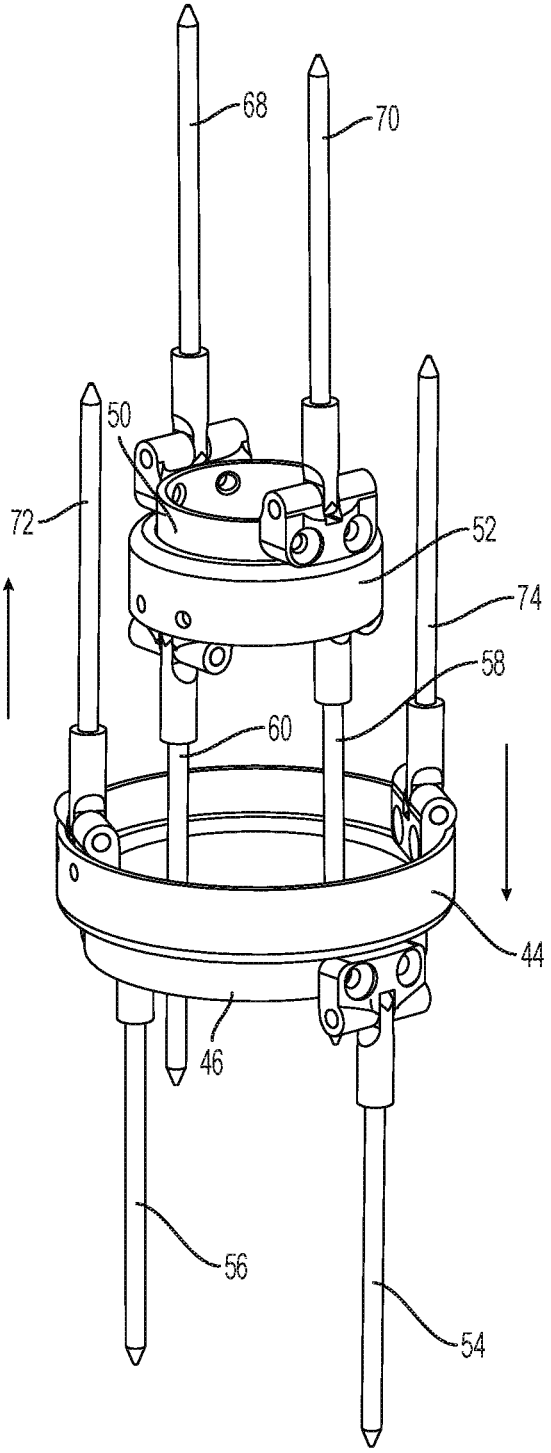
FIG. 21 is a schematic view of the bearing ring assemblies and cables when the bearing ring assemblies have separated as shown by the arrows.
Figure 22:
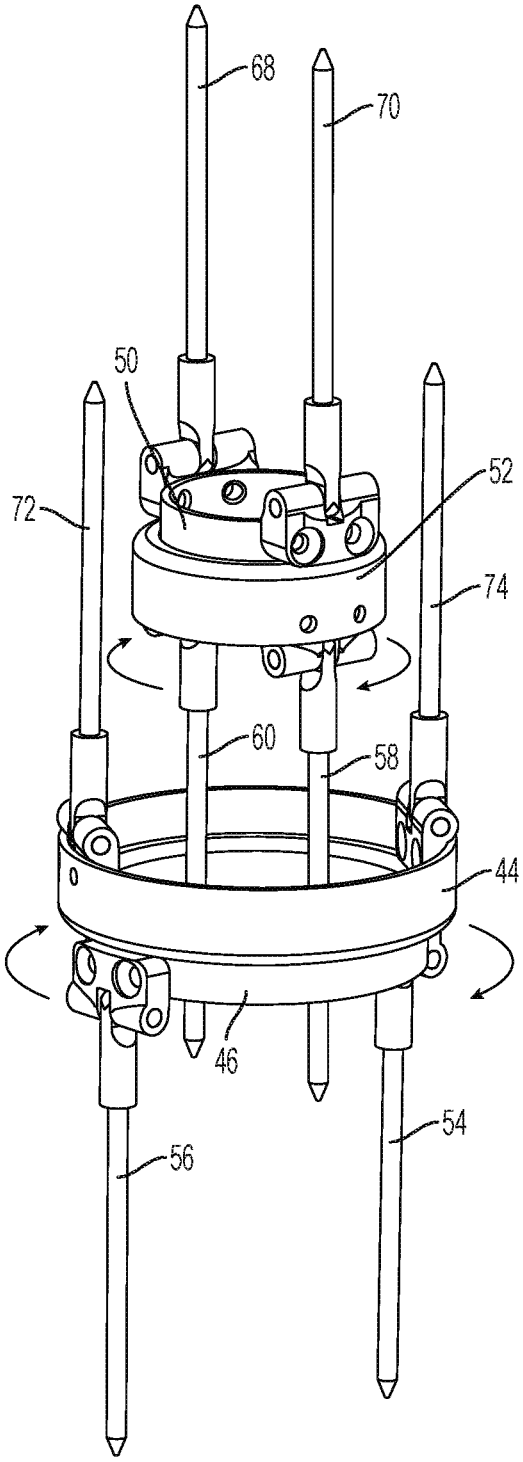
FIG. 22 is a schematic view showing by arrows the direction of rotation of the lower ring of each of the large outer and small inner bearing ring assemblies shown in FIG. 21.

As shown in FIG. 4, the supporting structure for the propulsion mechanism is spine 21.

The drums 40 and 42 are rotated about a horizontal axis represented by shaft 45 in FIG. 4. As can be seen in FIGS. 7, 11, 13, 19, 27, 37, 38, 44, 46 and 48, the fins 32 and 34 oscillate on a horizontal axis through an arcuate path to propel the watercraft.

Figure 23:
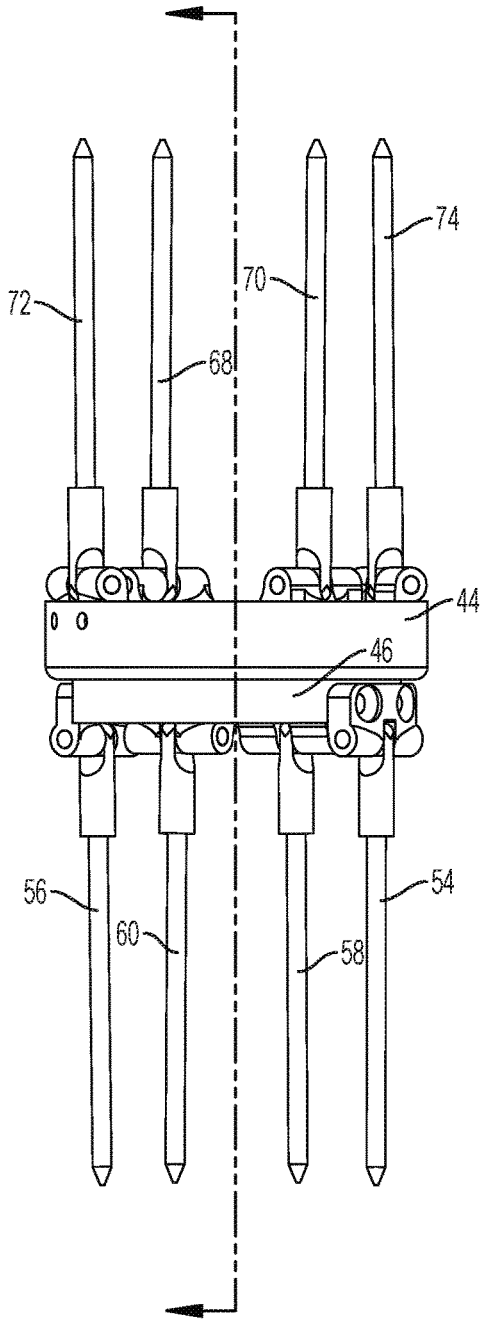
FIG. 23 shows schematically the large outer and small inner bearing ring assemblies when nested with more detail of the attachment points of the cables.
Figure 24:
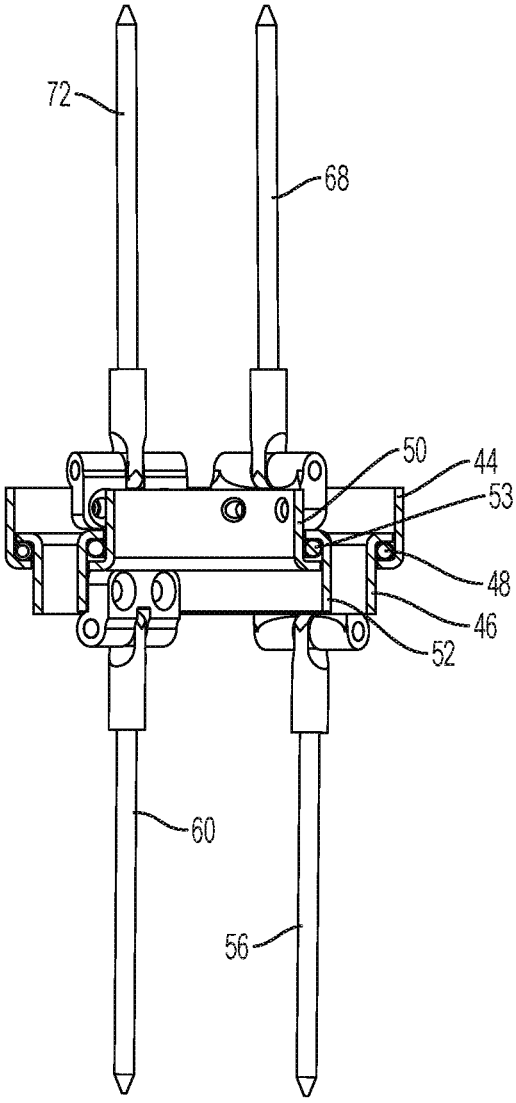
FIG. 24 is a sectional view taken along line 24-24 in FIG. 23 showing the bearings.
Figure 25:
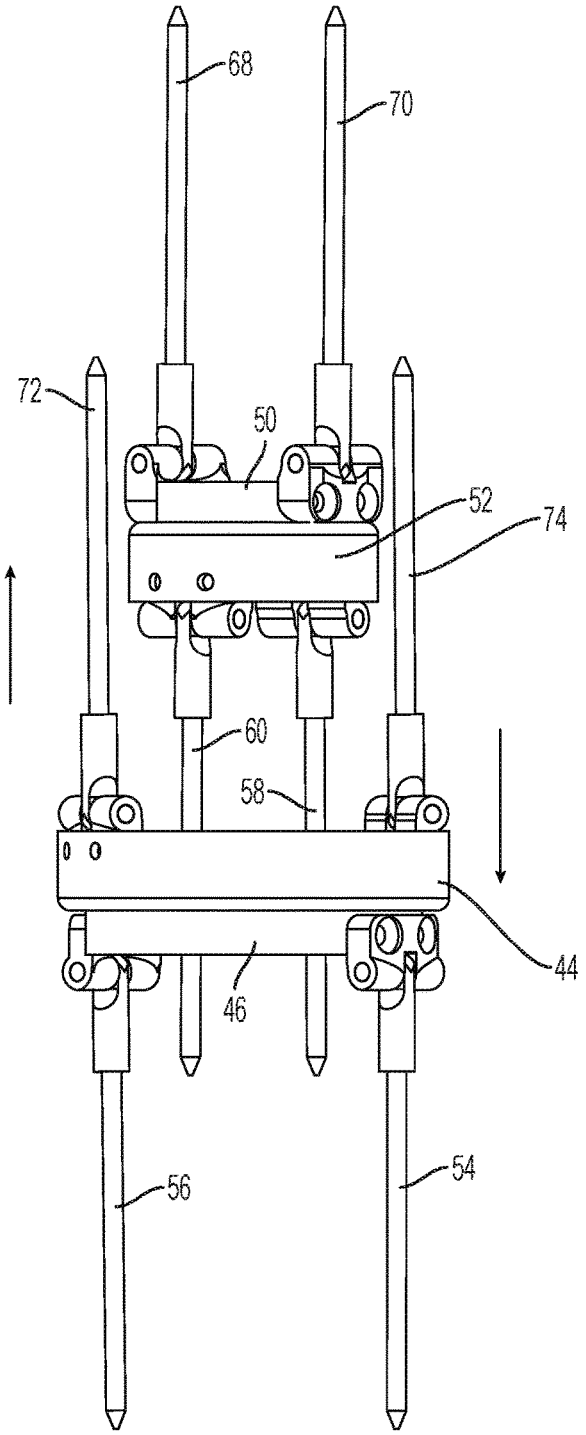
FIG. 25 shows the large outer and small inner bearing ring assemblies when separated as indicated by the arrow with more detail of the attachment points of the cable.
Figure 29:
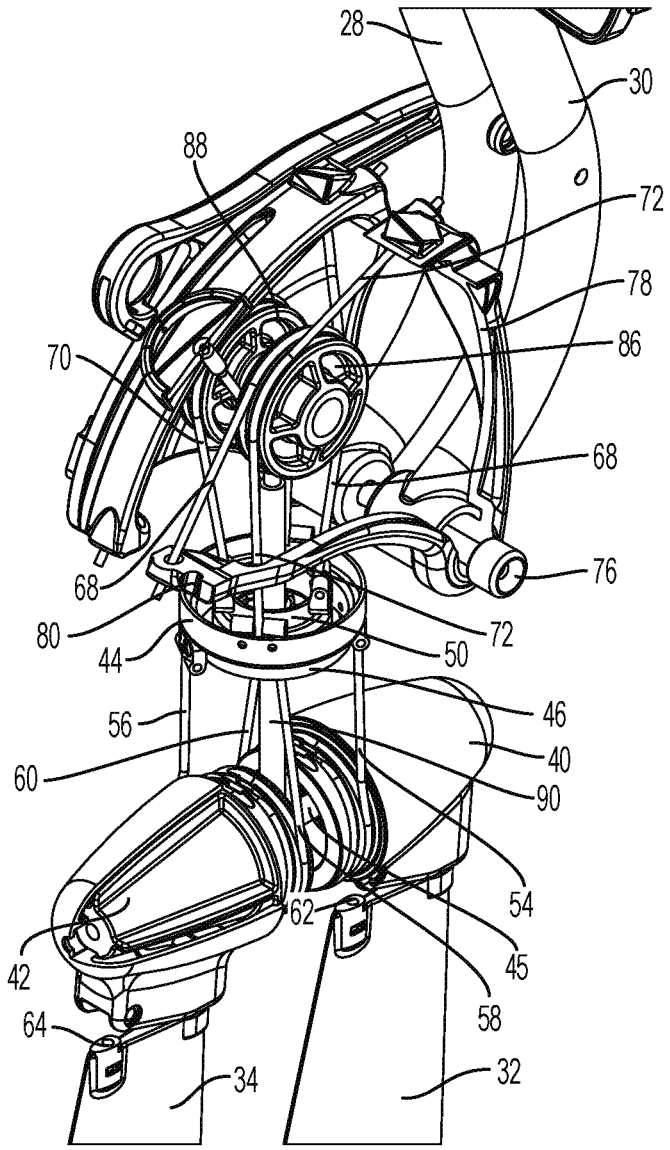
FIG. 29 is similar to FIG. 26, further showing cable connections.
Figure 30:
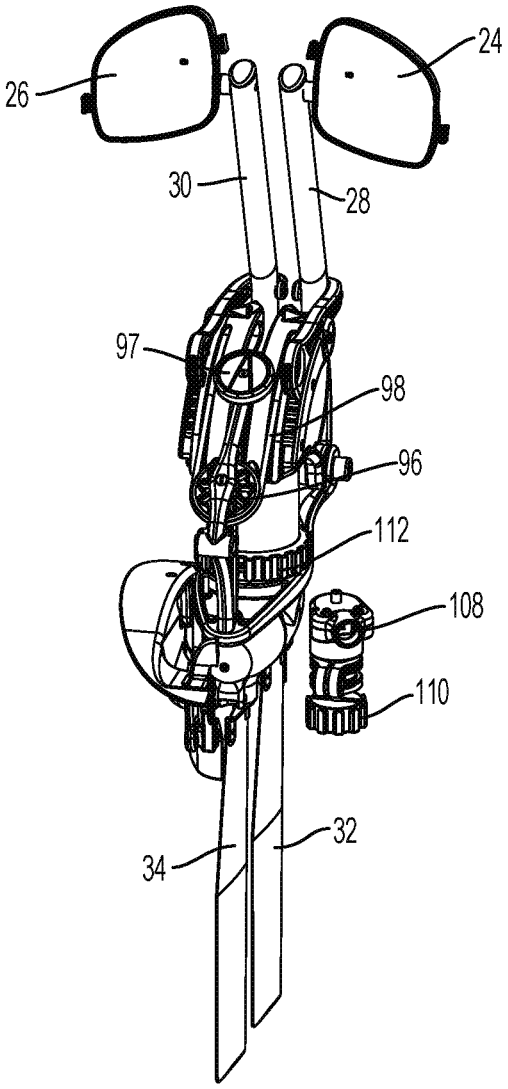
FIG. 30 is an exploded view from the right rear showing the main steering gear ring and the geared fitment which connects to the compression tube shown in FIGS. 3 and 5.
Figure 31:
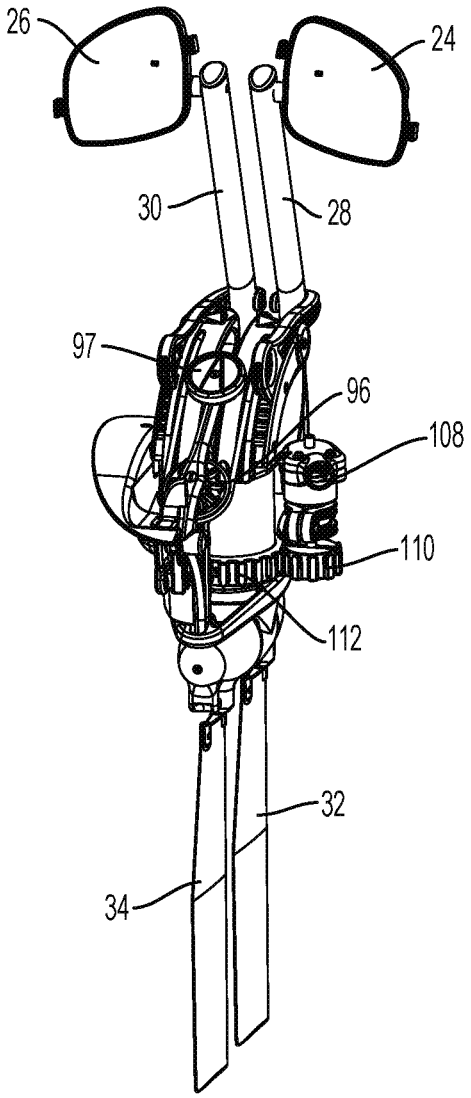
FIG. 31 is similar to FIG. 30 showing the gear elements engaged.
Figure 32:
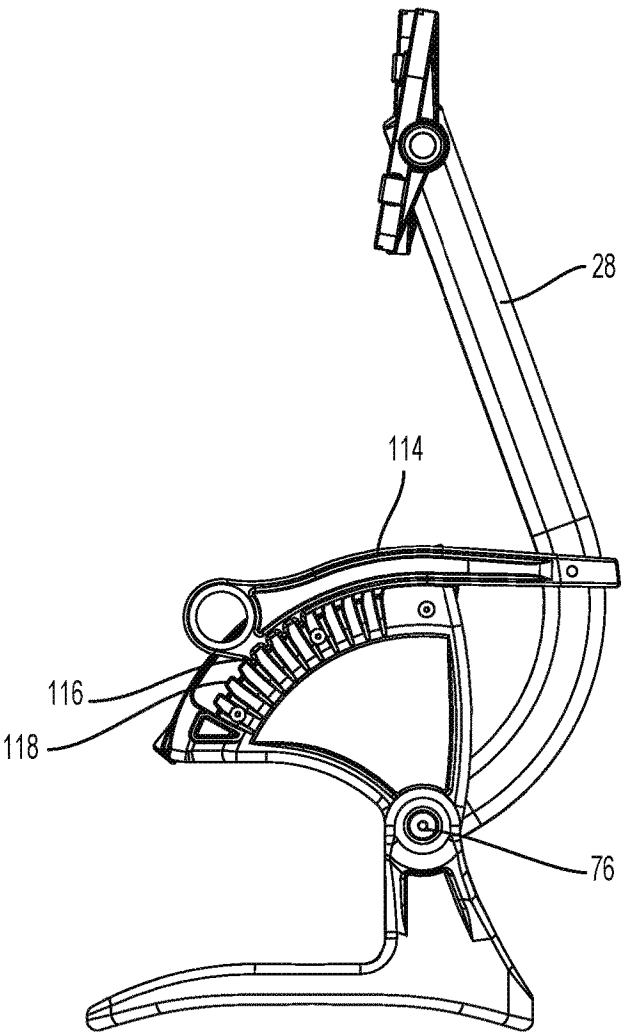
FIG. 32 is a side view of the propulsion mechanism, with parts removed to show the pedal shaft and adjustment arm in a first engaged position.
Figure 33:
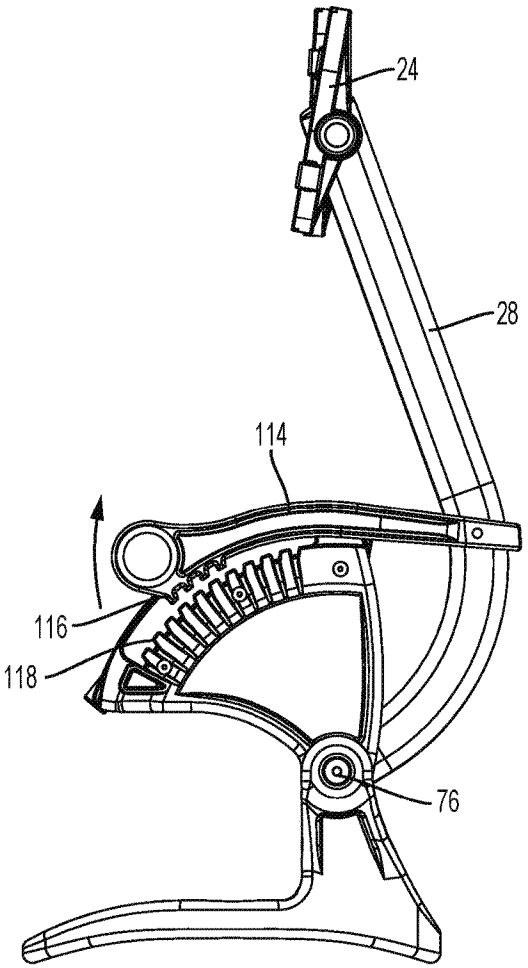
FIG. 33 shows in side view the lifting of the adjustment arm to disengage and begin to change the position of the pedal shaft.

Turning to the invention in more detail, in FIG. 29 the large and small bearing ring assemblies are nested, the smaller bearing ring assembly 36 inside the larger bearing ring assembly 38. Referring to FIGS. 23 and 24, each bearing ring assembly has an upper and lower ring separated by a ring of ball bearings. In FIGS. 23 and 24 the two bearing ring assemblies are nested, one inside the other. As show in FIG. 24, the large bearing ring assembly 38 has an upper non-rotatable ring 44 and a lower rotatable ring 46. The lower ring 46 rotates with respect to the upper non-rotatable ring 44 on ball bearing ring 48. The smaller inner bearing ring assembly 36 also has an upper non-rotatable small ring 50 and a lower rotatable small ring 52. The lower ring 52 rotates on ball bearing ring 53.

Each rotatable ring 46, 52 carries two downwardly extending cables. Rotatable ring 46 carries cables 54 and 56. Rotatable ring 52 carries cables 58 and 60.

Figure 28:
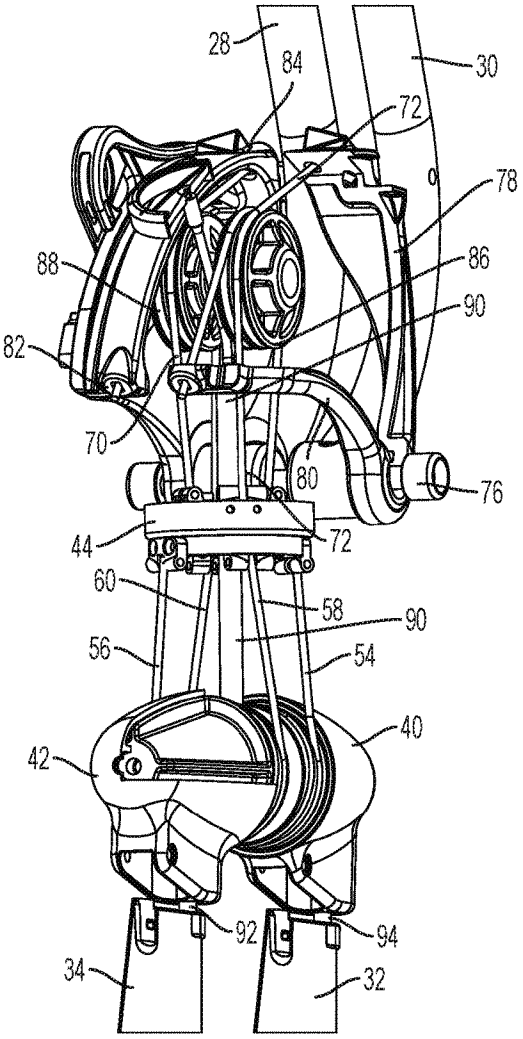
FIG. 28 is similar to FIG. 26, but taken from the lower right rear.

As shown in FIGS. 28 and 29, cable 54 runs to the front of drum 40. Cable 56 runs to the rear of drum 42. Likewise, cable 58 runs to the front of drum 42 and cable 60 runs to the rear of drum 40.

Non-rotatable small ring 50 carries two upwardly extending cables 68 and 70. Non-rotatable ring 44 also carries two upwardly extending cable 72 and 74.

As shown in FIG. 29 pedal shafts 28 and 30 rotate about a fixed shaft 76. Shaft 76 carries cable guides 78 and 80 which rotate with pedal shaft 28 about shaft 76. The cable guides 82 and 84 rotate with pedal shaft 30 about shaft 76 as shown in FIG. 28.

A pair of pulleys 86 and 88 are carried at the top of central vertical shaft 90. Each pulley supports two of the cables 68 and 72 passing over pulley 86 and cables 70 and 74 passing over pulley 88.

When pedal 24 is advanced cable 72 and large bearing ring assembly 38 is pulled up and cable 68 moves down with small bearing ring assembly 36.

The horizontal shaft 45 carries the drums 40 and 42 to which is joined masts 92 and 94, carrying fins 32 and 34. The horizontal shaft 45 is connected to central vertical shaft 90. The vertical shaft 90 projects upwardly and generally, although not necessarily, forms a substantially right angle to the longitudinal dimension of the watercraft.

The horizontal shaft 45 is continuously rotatable through 360° in either direction about vertical shaft 90.

In the preferred embodiment shown in FIGS. 30, 31, 35, 51 and 52, steering is performed by the occupant of the cockpit by operating handle 104 with steering rod 105 which is coupled to compression tube 106 containing toothed belt 120 through connection 108 to turn pinion gear 110. Pinion gear 110 engages ring or spur gear 112 which is carried by vertical shaft 90.

As shown in FIG. 29, each of the flexible fins is rotatable about its mast, so that the edge of the fin opposite the leading edge can move from one side to the other with respect to the center line of drums 40 and 42. This action results in the pair of flexible fins exerting of forward force or push on the watercraft in both directions of movement of the pair of flexible fins, providing superior efficiency and speed. The extent of travel or movement of the trailing edges is limited by the adjustment provided by tensioners 62 and 64.

Figure 26:
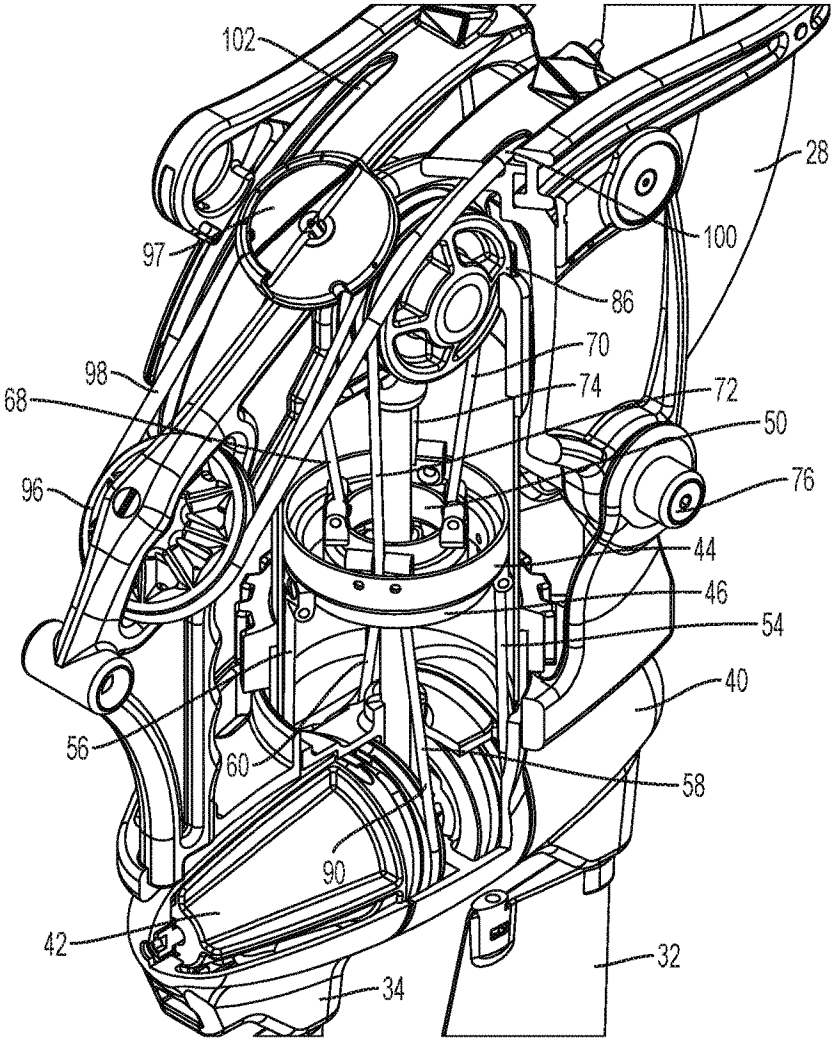
FIG. 26 is a view from the upper right rear showing the propulsion mechanism with parts removed to expose the cable connections between the pedal cranks and the nested large and small bearing ring assembly, as well as the cable connections between the rotatable lower ring of each bearing ring assembly and the drums each with attached mast carrying a flexible fin.
Figure 27:
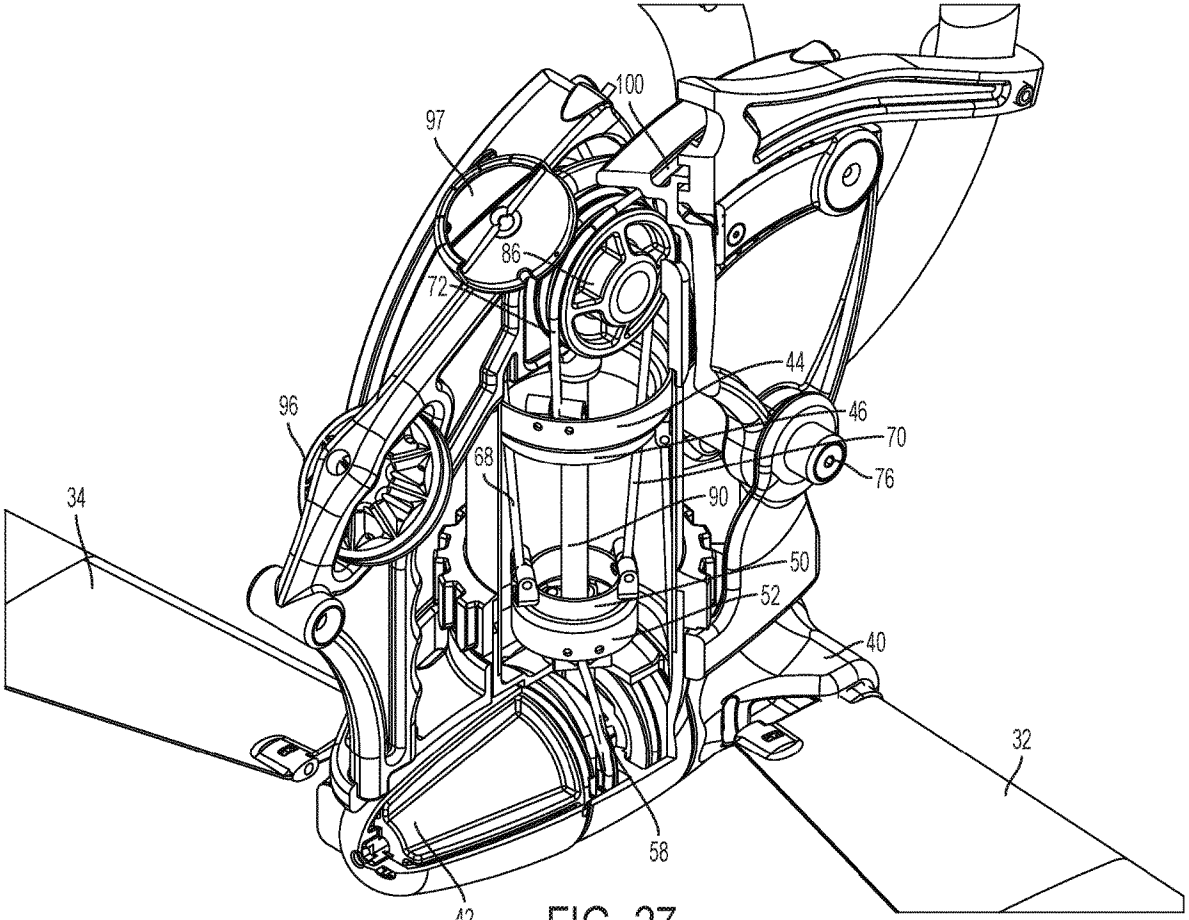
FIG. 27 is similar to FIG. 26 except that the pedal shafts have moved to cause the small inner bearing ring assembly to move down and the large outer bearing ring assembly to move up accompanied by the 90° rotation of each flexible fin.

As shown in FIGS. 26 and 27, the rear pulley 96 carries cable 98 which runs from attachment 100 connected to pedal shaft 28 to attachment 102 connected to pedal shaft 30. When one pedal is advanced by the application of input force, the other is pulled back. In this way, one bearing assembly is pulled up, the other bearing assembly is pulled down as the pedal is advanced, and the other pedal is pulled back, thereby being made ready to be advanced by input force to the other pedal to pull up the other bearing assembly. These movements repeat as pedaling occurs, the occupant applying input force to one pedal and then the other pedal.

Figure 34:
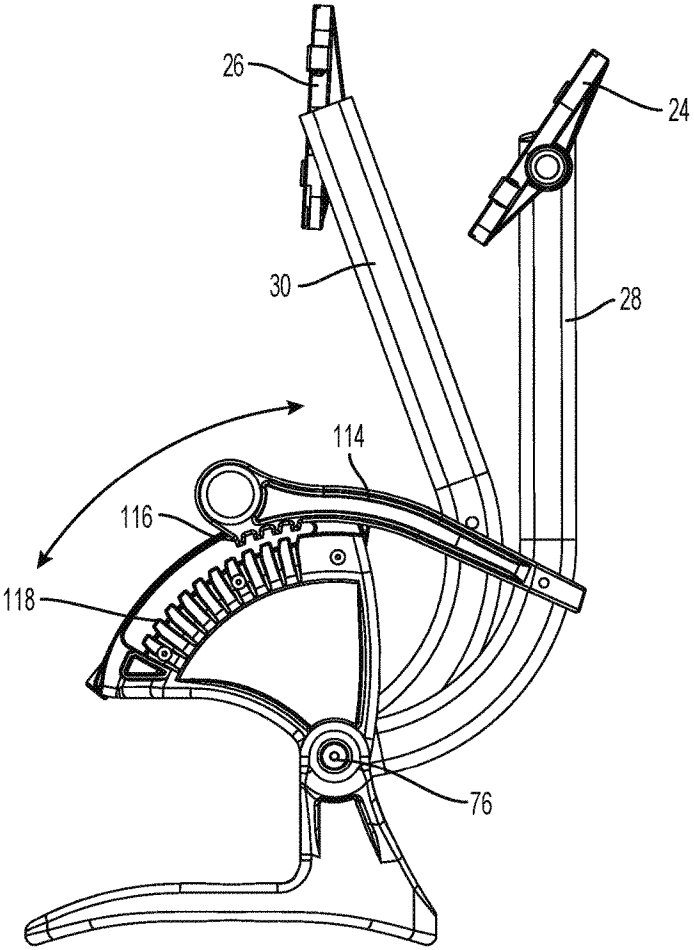
FIG. 34 shows in side view the pedal shaft and adjustment arm moved to a second position prior to engagement.
Figure 35:
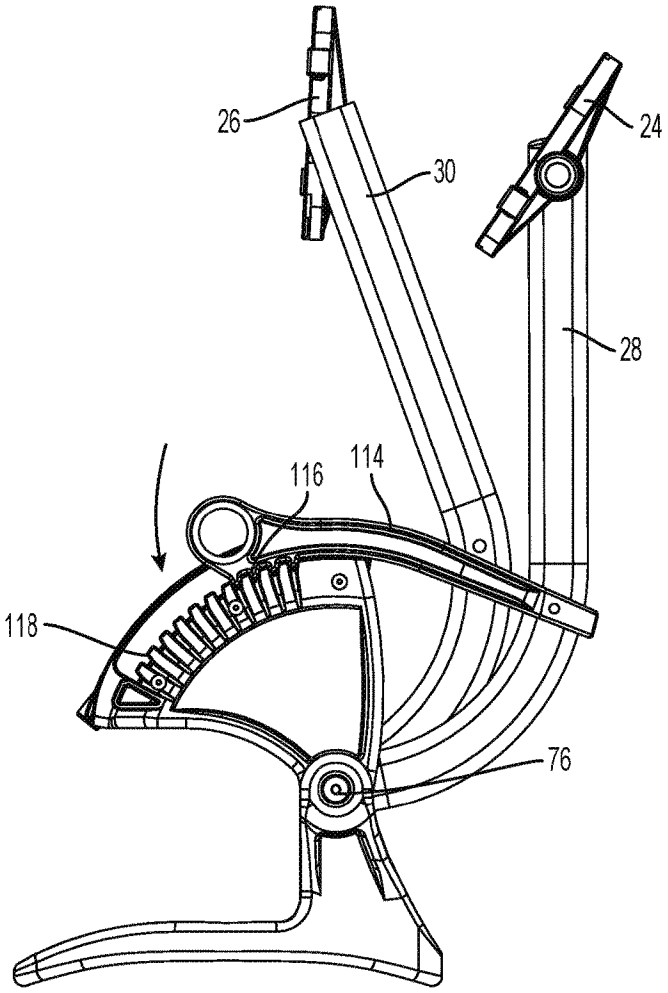
FIG. 35 shows in side view the pedal shaft and adjustment arm engaged in the second position.
Figure 36:
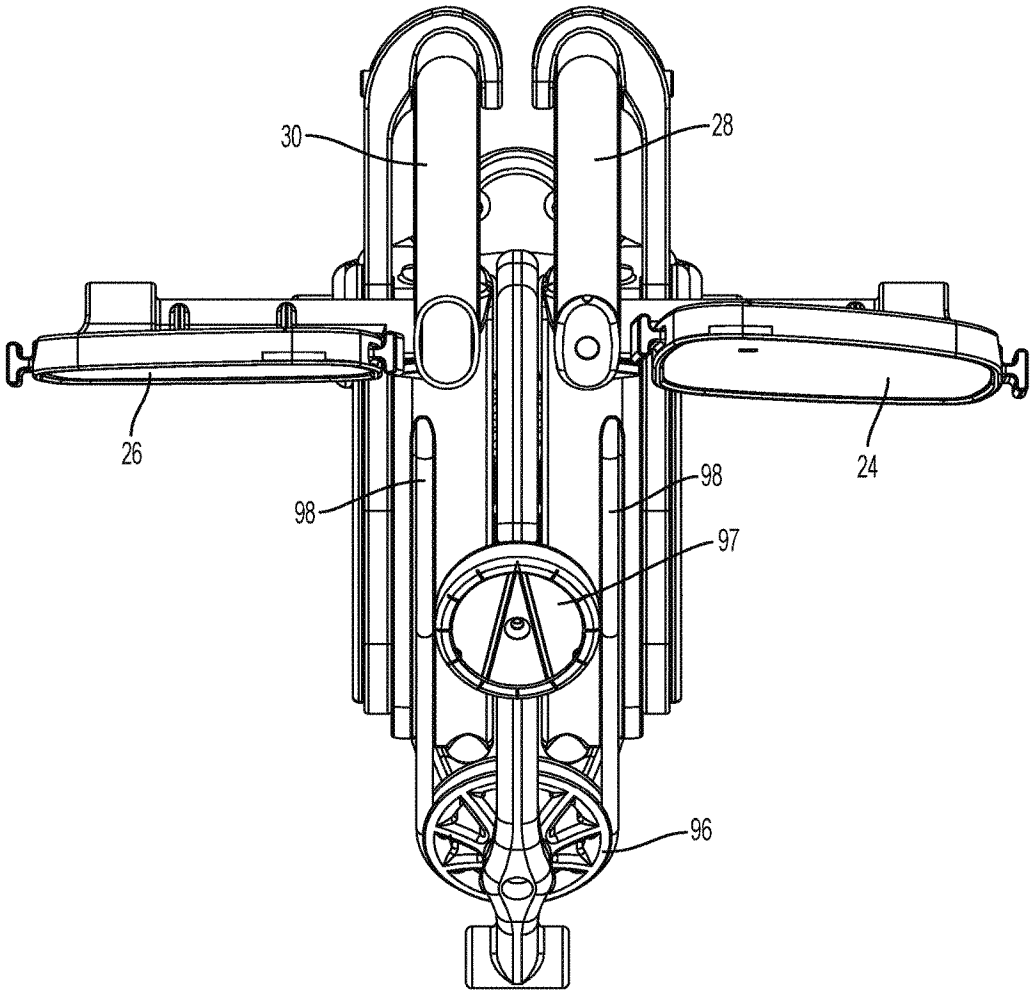
FIG. 36 is a top plan view of the propulsion mechanism when steered in the straight ahead position as indicated by the arrow on the direction indicator to propel the watercraft forward.
Figure 37:
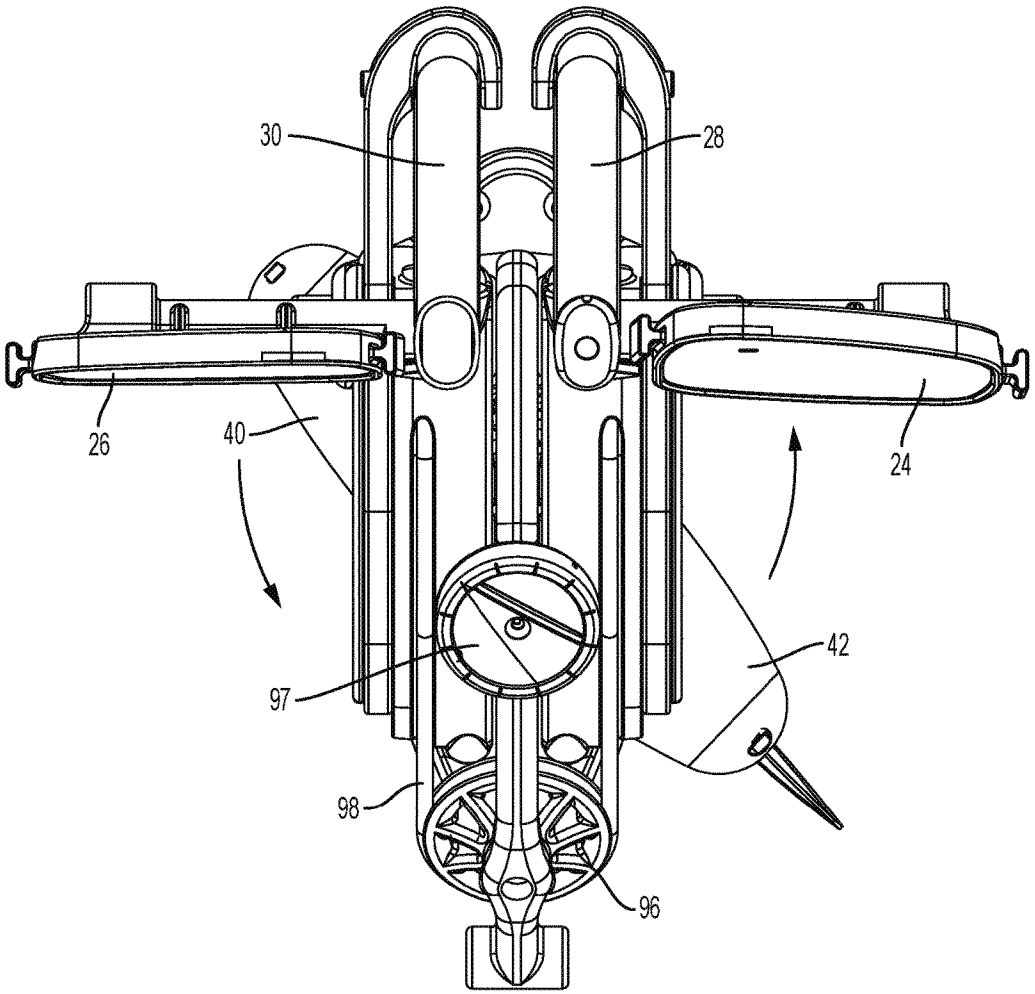
FIG. 37 is another top plan view of the propulsion system steered to propel the watercraft to the left as indicated by the arrow on the direction indicator.
Figure 38:
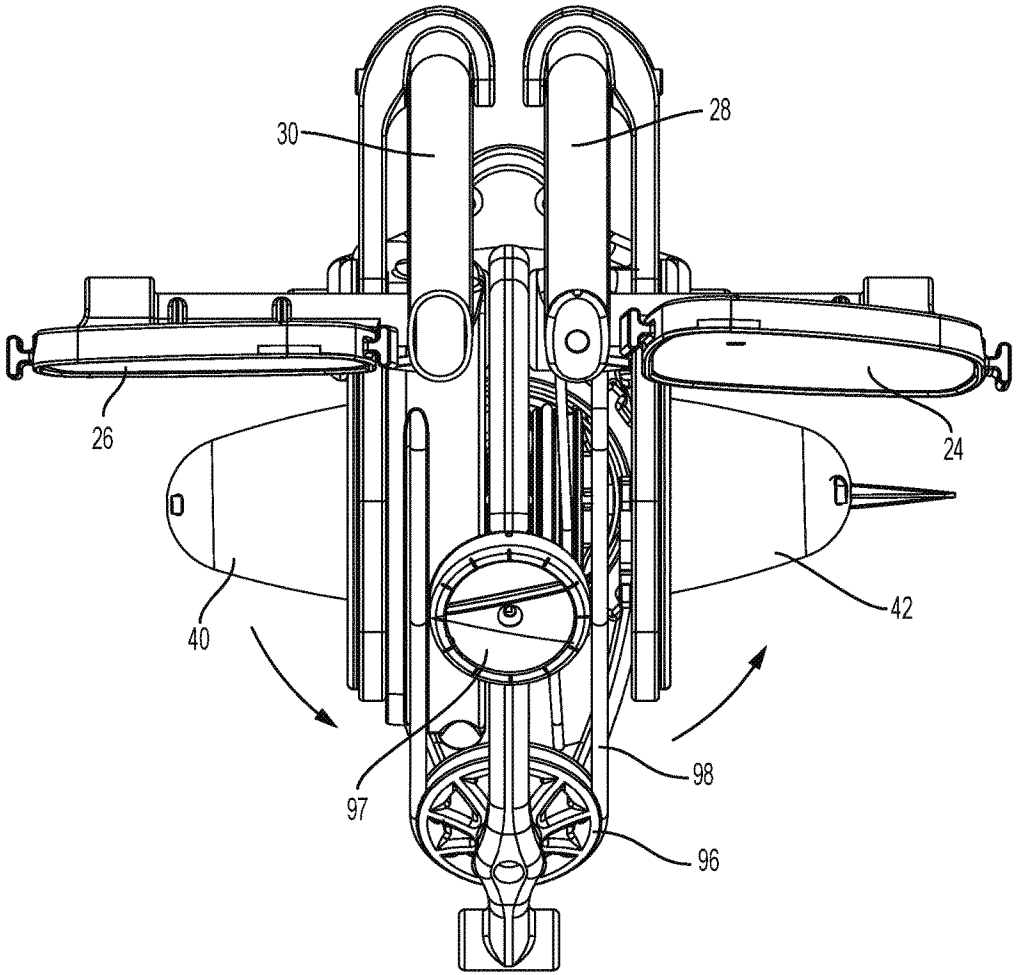
FIG. 38 is a top plan view of the propulsion system steered 90° to the left.
Figure 39:
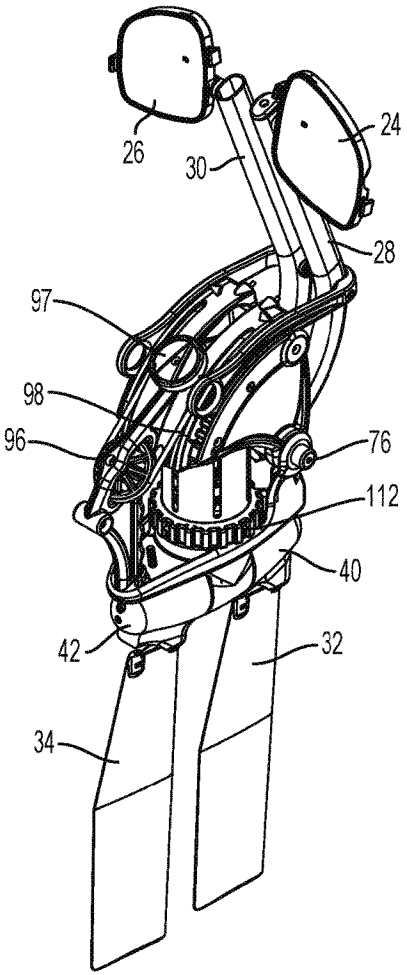
FIG. 39 is a side view from the rear of the propulsion system steered as shown in FIG. 36.
Figure 40:
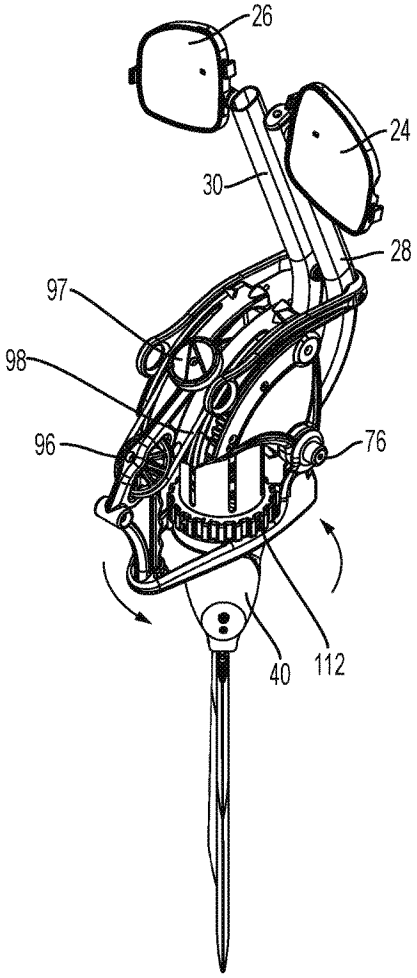
FIG. 40 is a side view from the rear of the propulsion system steered as shown in FIG. 37.
Figure 41:
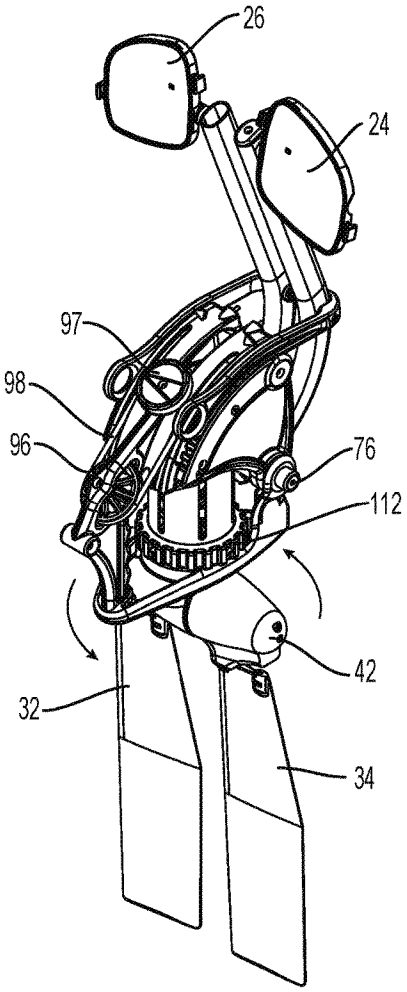
FIG. 41 is a side view from the rear of the propulsion system steered as shown in FIG. 38.
Figure 42:
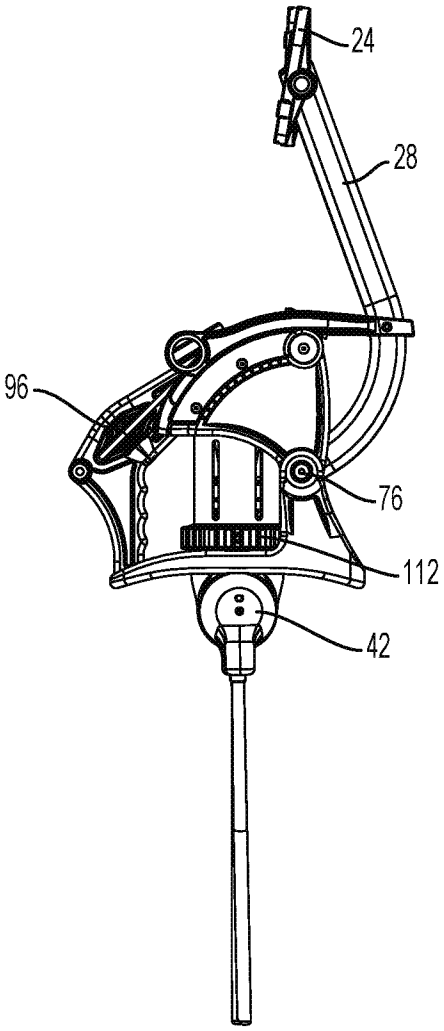
FIG. 42 is a side view of the propulsion system steered 90° to the left.
Figure 43:
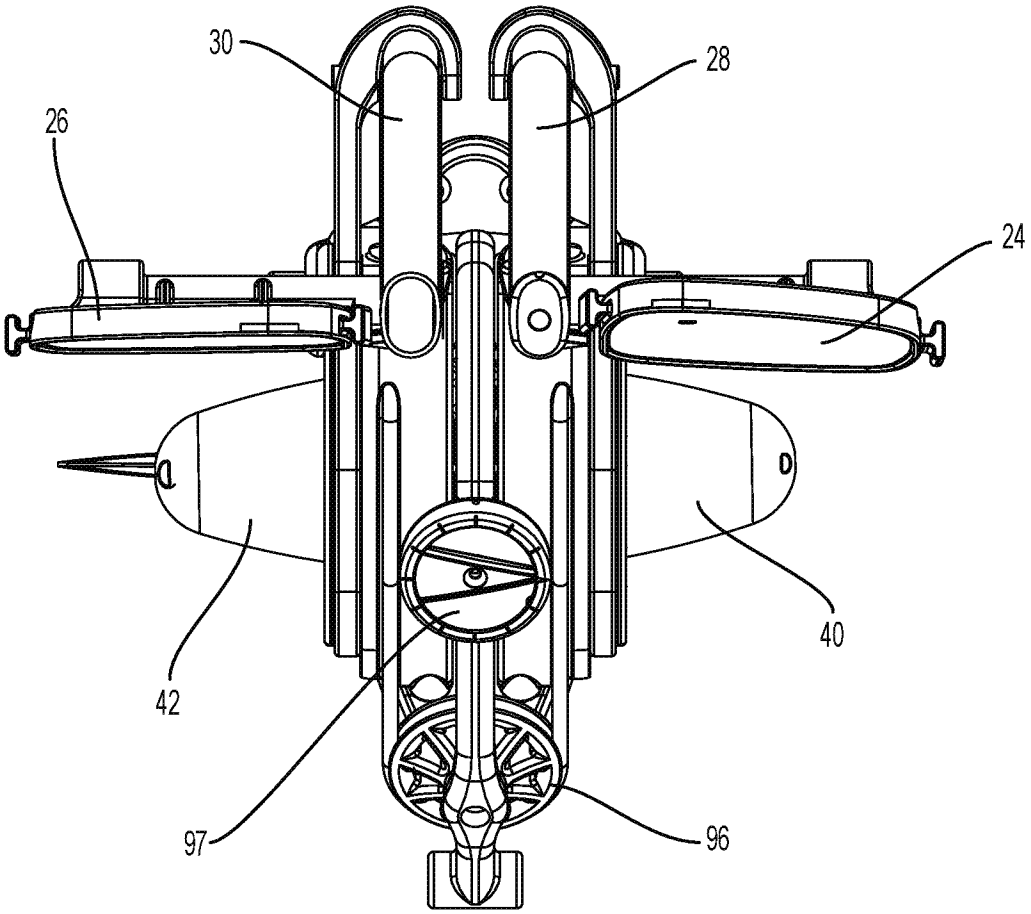
FIG. 43 is a top view of the propulsion system when steered to the right as shown on the direction indicator.
Figure 44:
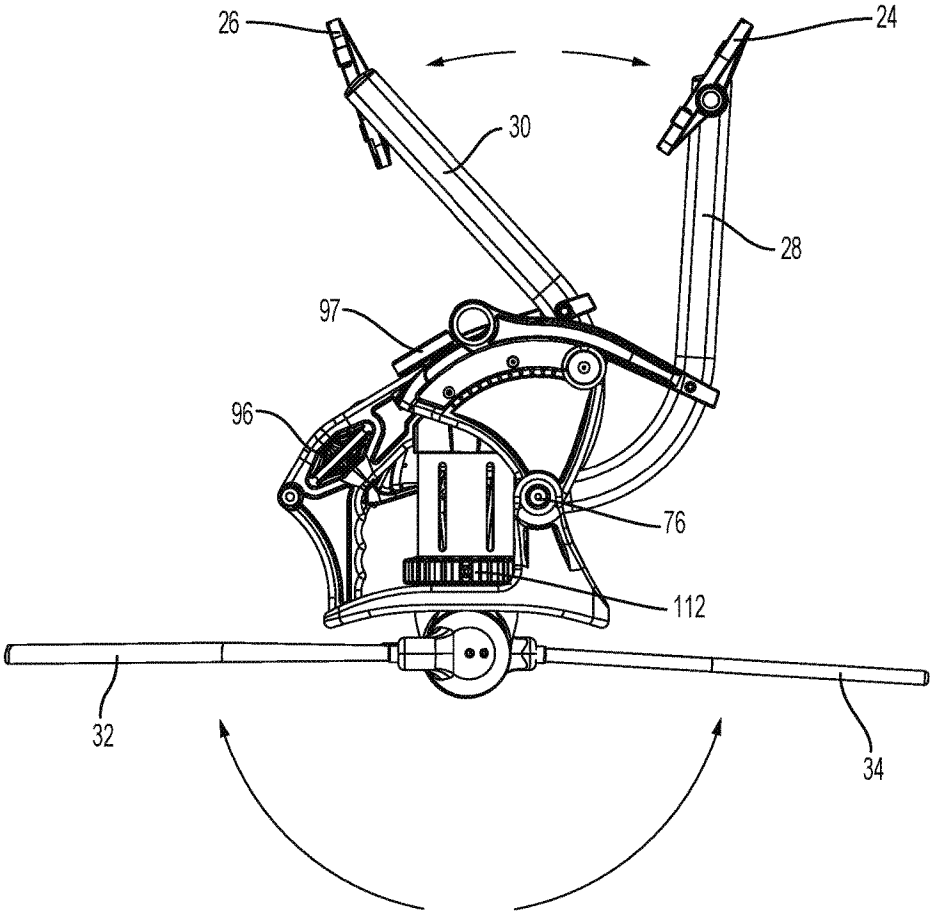
FIG. 44 is a side view of the propulsion system steered 90° to the right with the pedals moved as indicated by the arrows resulting in the movement of the pair of flexible fins about the horizontal shaft.
Figure 45:
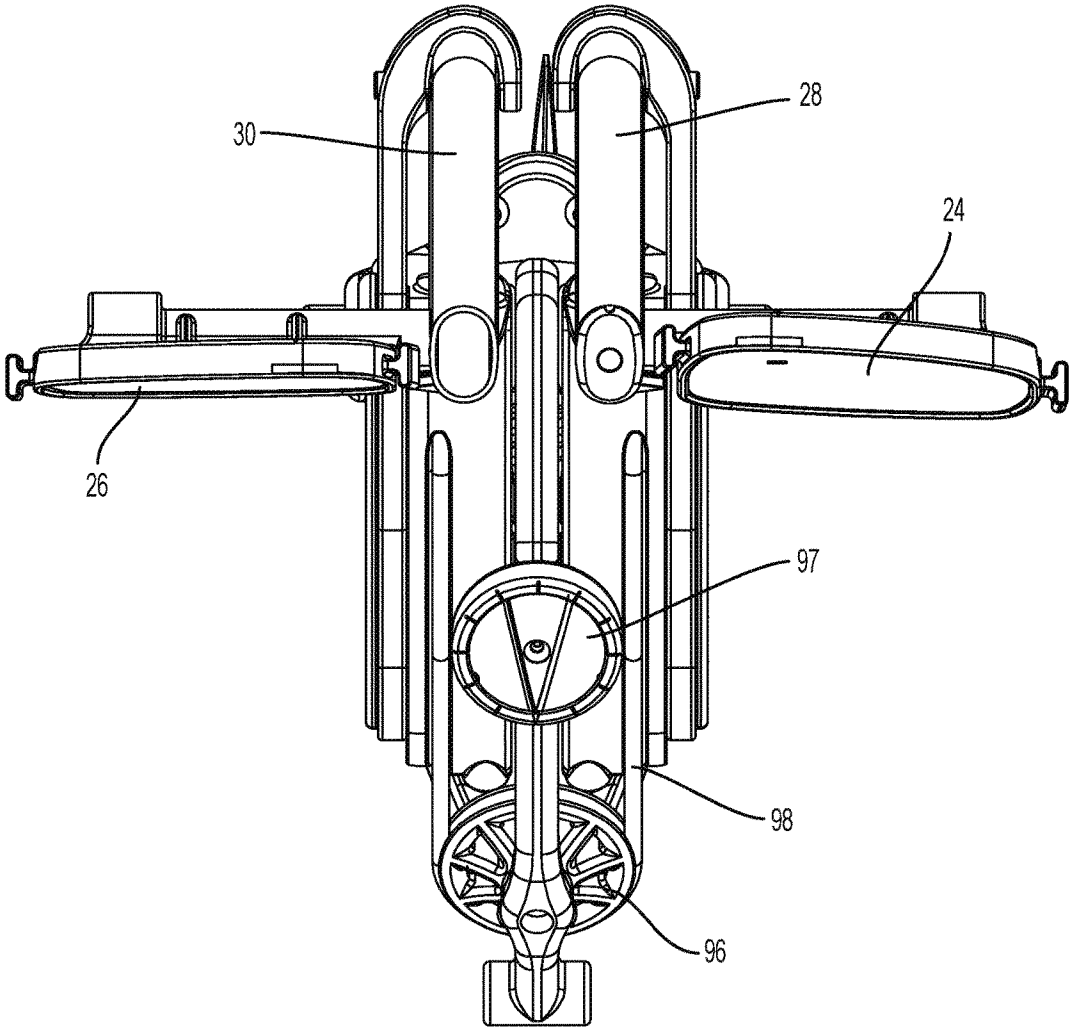
FIG. 45 is a top plan view of the propulsion system when steered to the rear to propel the watercraft aft.
Figure 46:
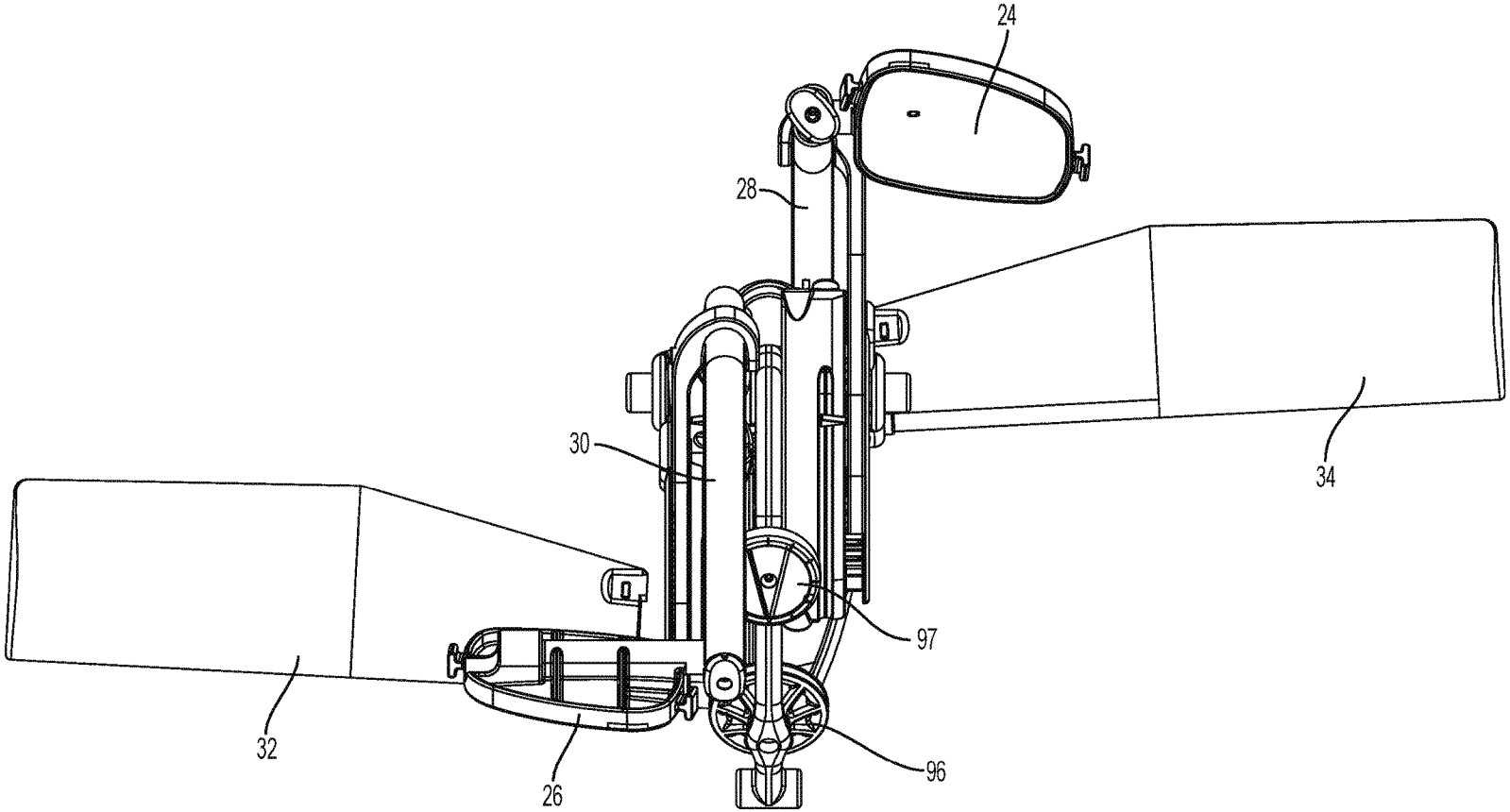
FIG. 46 is a top plan view of the propulsion system with the pedals and pair of flexible fins positioned as shown to propel the watercraft aft.
Figure 47:
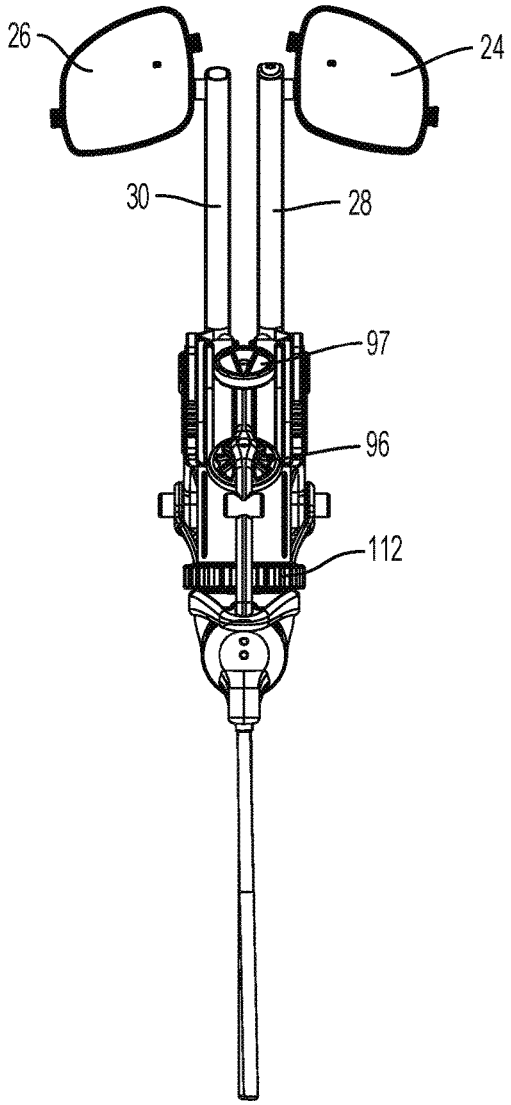
FIG. 47 is a rear plan view of the propulsion system with the pair of flexible fins positioned as in FIG. 45.
Figure 48:
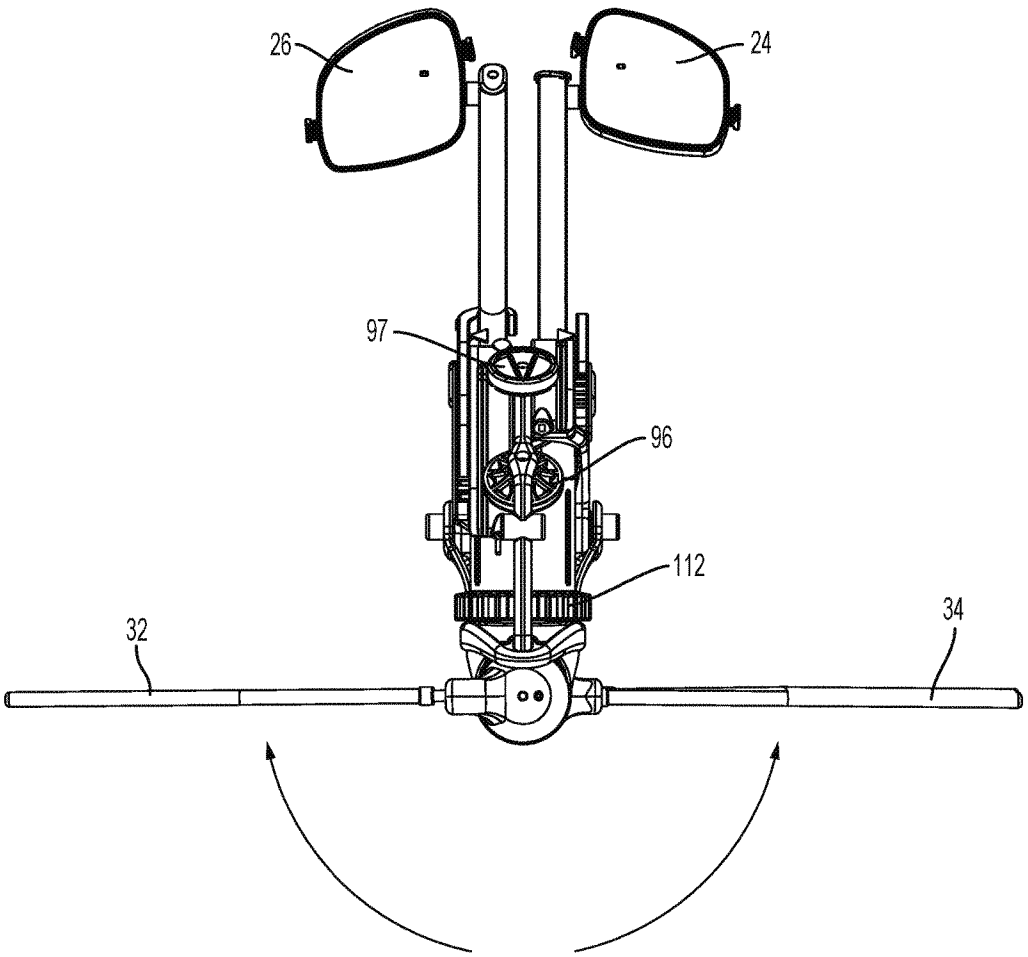
FIG. 48 is a rear plan view of the propulsion system with the pair of flexible fins positioned as in FIG. 46.

FIGS. 32 to 35 illustrate a preferred feature of the invention. Each of the pedal shafts 28 and 30 carries a pivotally attached arm 114 having at its free end a series of teeth 116 which engage curved rack 118. By raising arm 114 as in FIG. 33 and moving the arm along with the pivotally attached pedal shaft, the teeth 116 can be made to engage at any point up or down the rack 118 as shown in FIG. 34, followed by re-engaging the teeth 116 at the selected location, FIG. 35. In this way, the occupant of the cockpit can adjust the distance from the cockpit to the pedals 24, 26 to suit.

Figure 49:
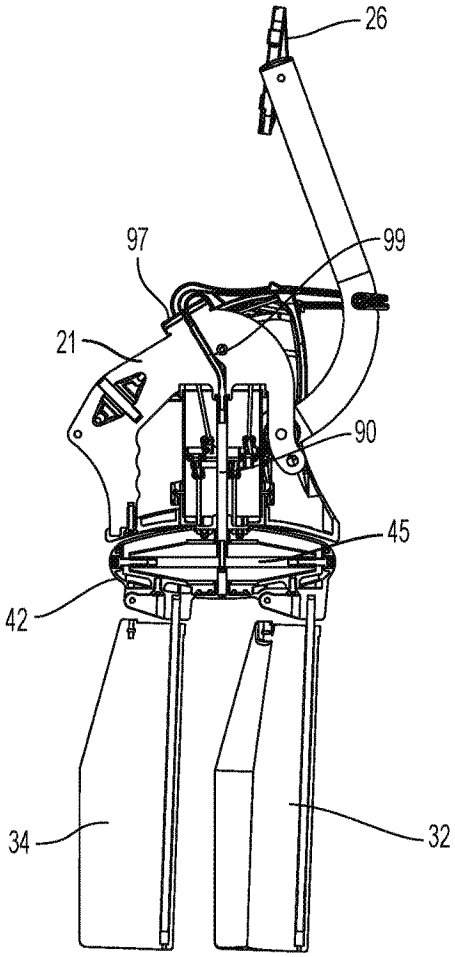
FIG. 49 is a cutaway view of the propulsion mechanism showing the connection of the direction indicator to the propulsion mechanism.
Figure 50:
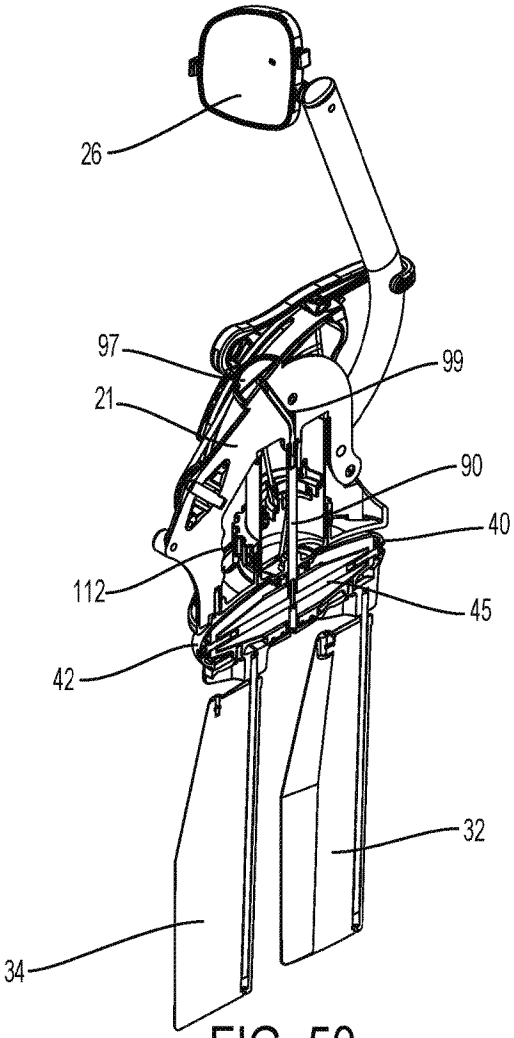
FIG. 50 is another cutaway view of the propulsion mechanism showing the connection of the direction indicator to the propulsion mechanism.

As shown in FIGS. 49 and 50, the direction indicator 97 is attached via a flexible rod 99 to the vertical shaft 90. This vertical shaft 90 is attached to the horizontal shaft 45 so the indicator rotates when the horizontal shaft 45, along with drums 40, 42 and flexible fins 32, 34, rotate.

Turning to the steering system of this invention in more detail, the drive steering system allows for the user to control the position of the lower unit of the drive, and therefore the direction of thrust, by operating a steering handle 104 located within arm's reach of the user. This handle 104 rotates around a vertical axis, and the direction the handle 104 is pointing correlates with the direction of thrust from the drive. This handle 104 can be rotated infinitely in either direction.

Figure 53:
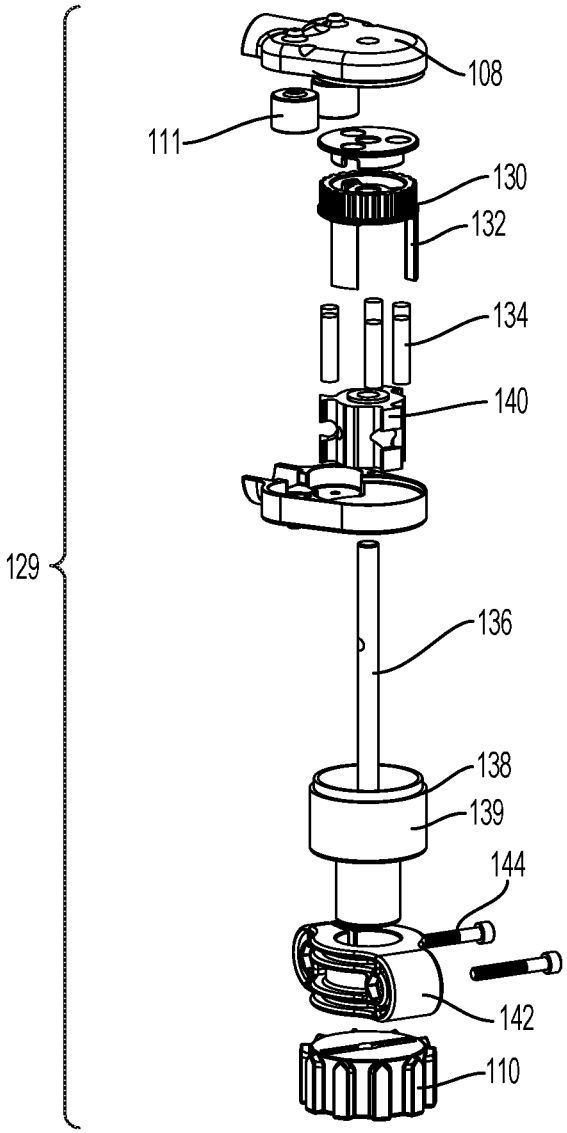
FIG. 53 is an exploded view with parts broken away of the clutch.
Figure 54:
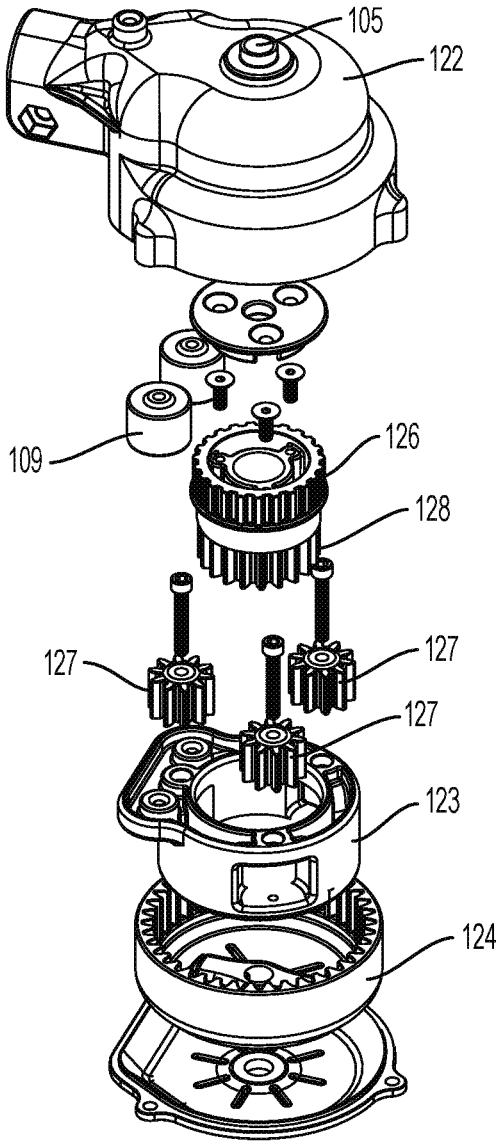
FIG. 54 is an exploded view of the steering mechanism with parts broken away.
Figure 55:
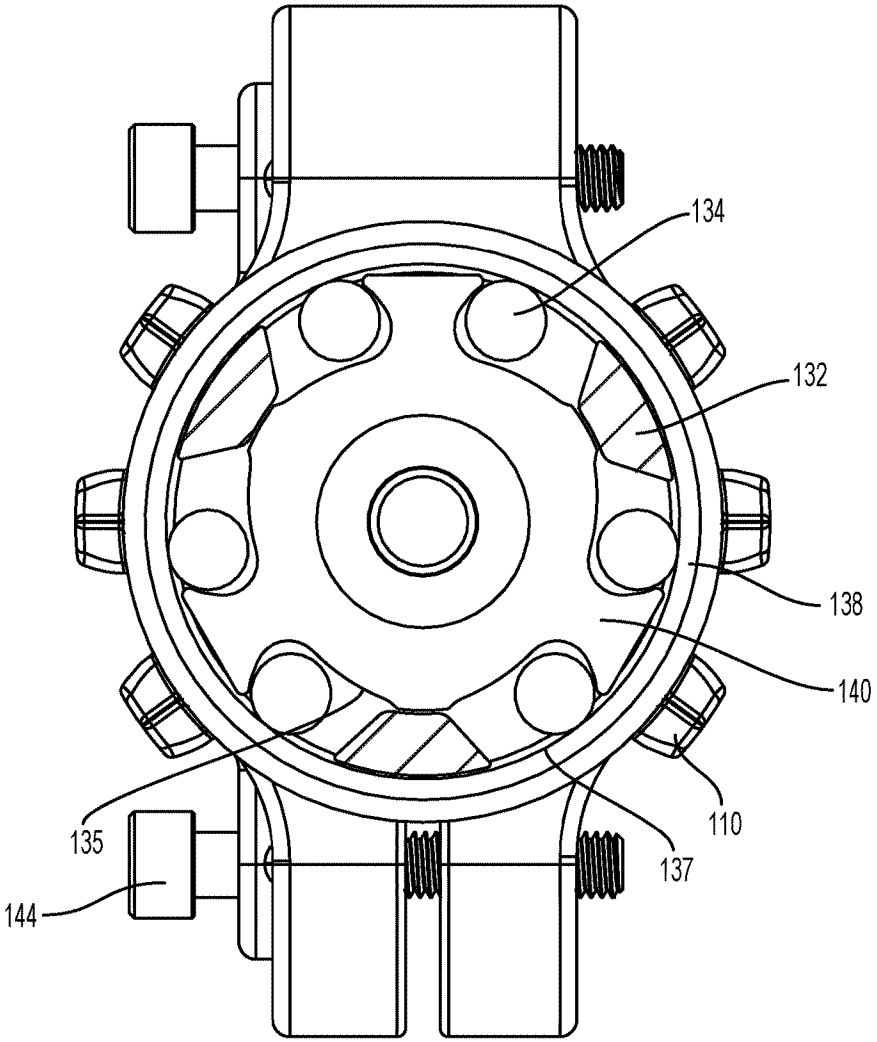
FIG. 55 is a top view of the clutch mechanism in cross-sectional view at rest.

The steering system, FIG. 54, comprises a handle 104 affixed to a vertical shaft 105 that enters the hull of the boat. The shaft 105 is then connected to the ring gear 124 of a planetary gear system within housing cover 122 and housing element 123. This planetary gear system both reverses the direction of rotation, and doubles the angular rotation. The sun gear 126 output of this planetary gear system 127 is mated to a toothed drum 128 that interfaces with the toothed belt 120. This belt 120 runs through the compression tube 106 to the clutch 129 that mates with the drive. Both the steering and the clutch are provided with a pair of idler pulleys 109, 111 to tension belt 120. The toothed belt 120 interfaces with a toothed drum 130 on the clutch system, FIG. 53. This drum has tines 132 attached to the bottom of it that extend down into a clutch. When the user turns the handle 104, these tines press on roller bearings 134, forcing them away from the inner wall 137 of the clutch sleeve 138, unlocking the clutch and allowing the steering system to rotate. The purpose of the clutch is to keep the propulsion mechanism fixed while the drive is in use, but to allow the user to turn the lower unit with the handle 104. Force from the lower unit will not release the clutch. If the lower unit is over forced (in the case of hitting a submerged object for example) there is a built in slip mechanism to allow all parts of the steering system to rotate, including the clutch. This is to avoid high load damaging the clutch or other components in the steering system. The output shaft from the clutch is mated to pinion gear 110 that interlocks with the spur gear 112 on the drive. When the drive is inserted into the drive well 20, these two gears 110 and 112 engage each other. The spur gear 112 on the drive is twice as big as the pinion gear 110, and these mated gears turn opposite directions. This is why the planetary gear ratio and reversal in the steering system is necessary.

Turning to FIGS. 53 and 55 to 62 in more detail, the Clutch—In the propulsion mechanism of this invention rotatable through 360°, there is preferably a dual clutch which is a subsystem of the steering system located in the well 20, directly next to the drive, interfacing with the lower unit of the drive by way of a 1:2 ratio pinion gear. When the drive is put into the well 20, the spur gear 112 on the drive mates slidably with the pinion gear 110 on the lower end of the dual clutch mechanism. This pinion gear 110 is affixed to the output shaft 136 of the clutch. The purpose of the clutch is to allow rotational force from the steering handle 104 to rotate the lower unit of the drive, while resisting any rotational torque from the lower unit of the drive on the clutch output shaft 136. This allows the drive to be locked in position whenever the user is not actively turning the drive with the steering handle 104.

Toothed Drum (input)—This is the drum 130 that interfaces with the belt 120. It is the input of the clutch. It is a toothed drum 130 with three tines 132 that extend down from the lower surface of the drum 130 and into the clutch. When the toothed drum 130 is rotated, the tines 132 protruding into the clutch contact the roller bearings 134, pulling them away from the inner wall 137 of clutch sleeve 138, allowing free rotation of the clutch output shaft 136.

Roller Bearings 134—There are six roller bearings 134, located inside the clutch.

Clutch sleeve 138 is the cylindrical component that surrounds the roller bearings. The inner wall 137 of the clutch sleeve 138 acts as a fixed clutch surface and interfaces with the roller bearings 134.

Trilobe—This is the lobed component 140 in the center of the clutch. It is affixed to the output shaft 136 of the clutch. Its function is to translate rotational force from the pinion gear 110 into a camming action of the roller bearings 134 between the inner wall 137 of clutch sleeve 138 and the cam surface 135 of the trilobe 140. This action locks the output shaft 136 of the clutch, holding the drive in position.

Spur Gear—This pinion gear 110 interfaces with the spur gear 112 on the drive, and is affixed to the output shaft 136 of the clutch.

Figure 56:
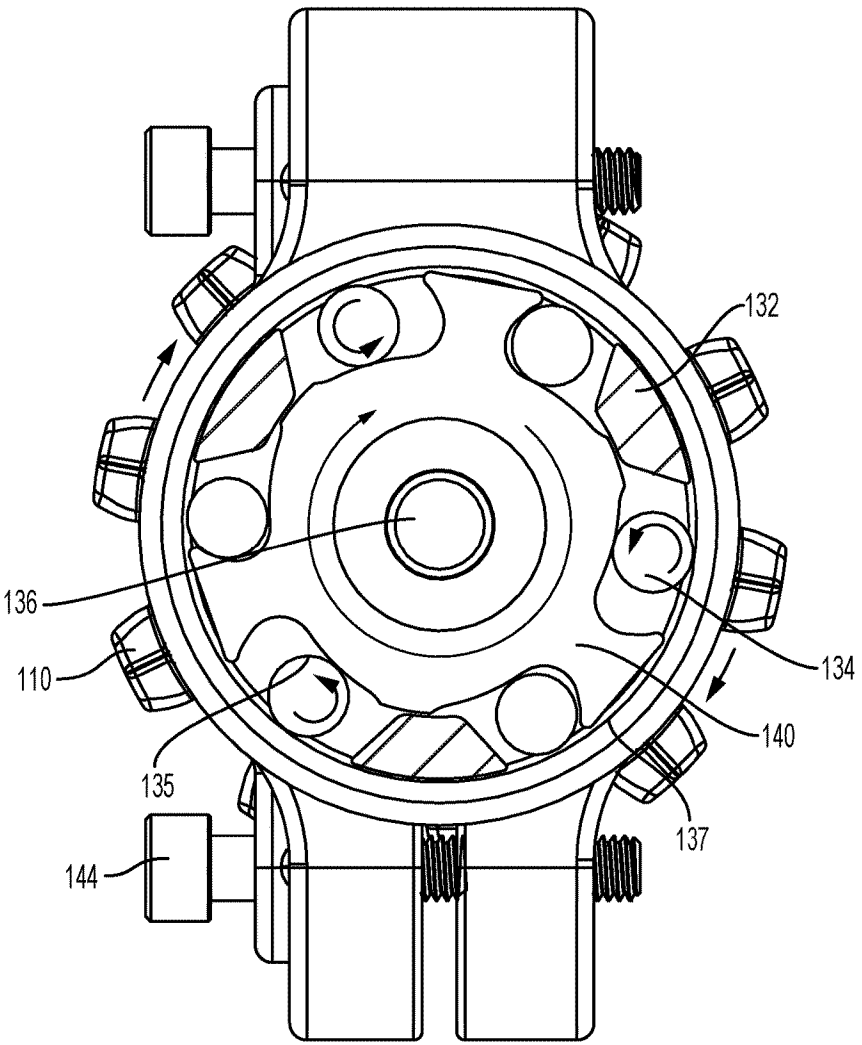
FIG. 56 is a top view, indicating by arrows the rotational force on the pinion gear, which is attached to the drive, showing the pinion gear as it rotates, rotating the trilobe, locking the clutch.
Figure 57:
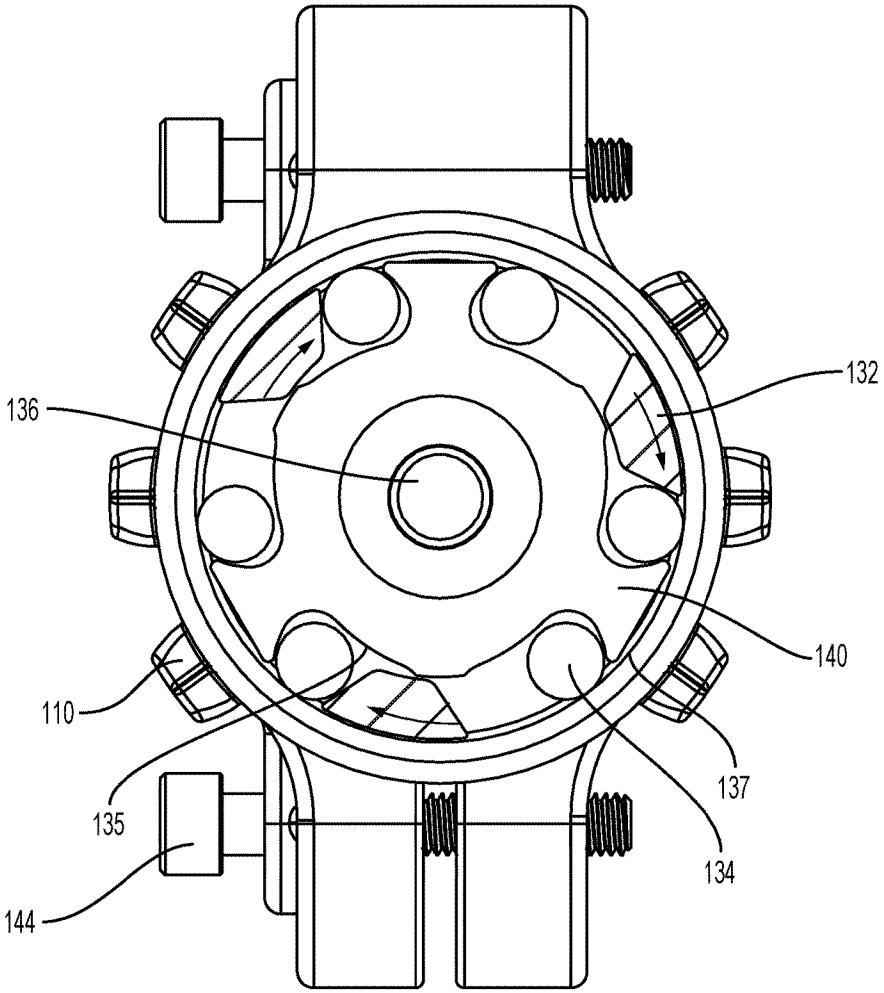
FIG. 57 is a top view showing input force on the toothed drum, rotating the tines inside the clutch, pressing the roller bearings away from the clutch sleeve, unlocking the clutch.
Figure 58:
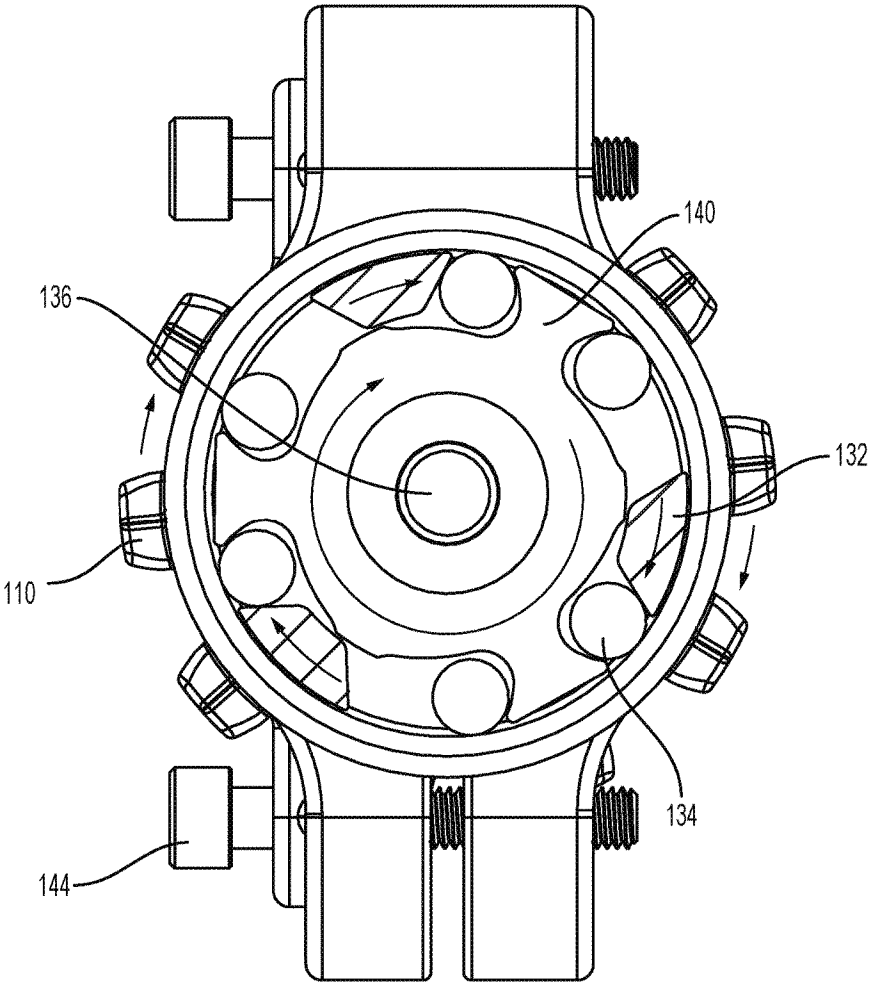
FIG. 58 is a top view showing the tines of the toothed drum pressing the roller bearings into the trilobe in turn rotating the drive.
Figure 59:
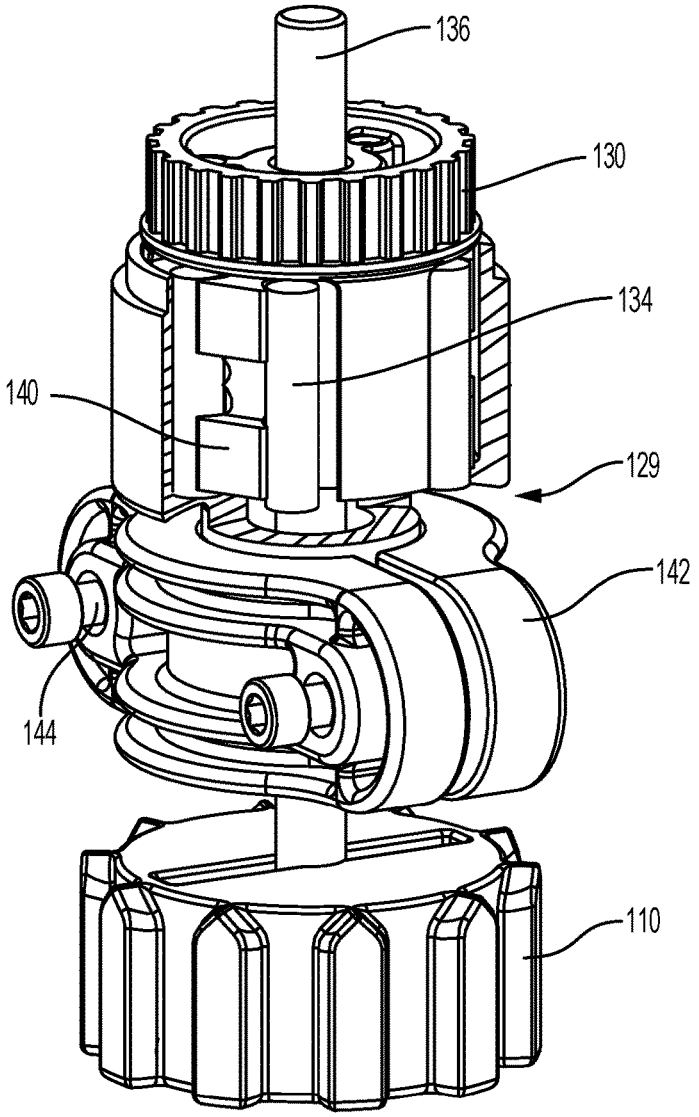
FIG. 59 is an isometric view of the clutch at rest h a cutaway in the clutch sleeve to show more detail.
Figure 60:
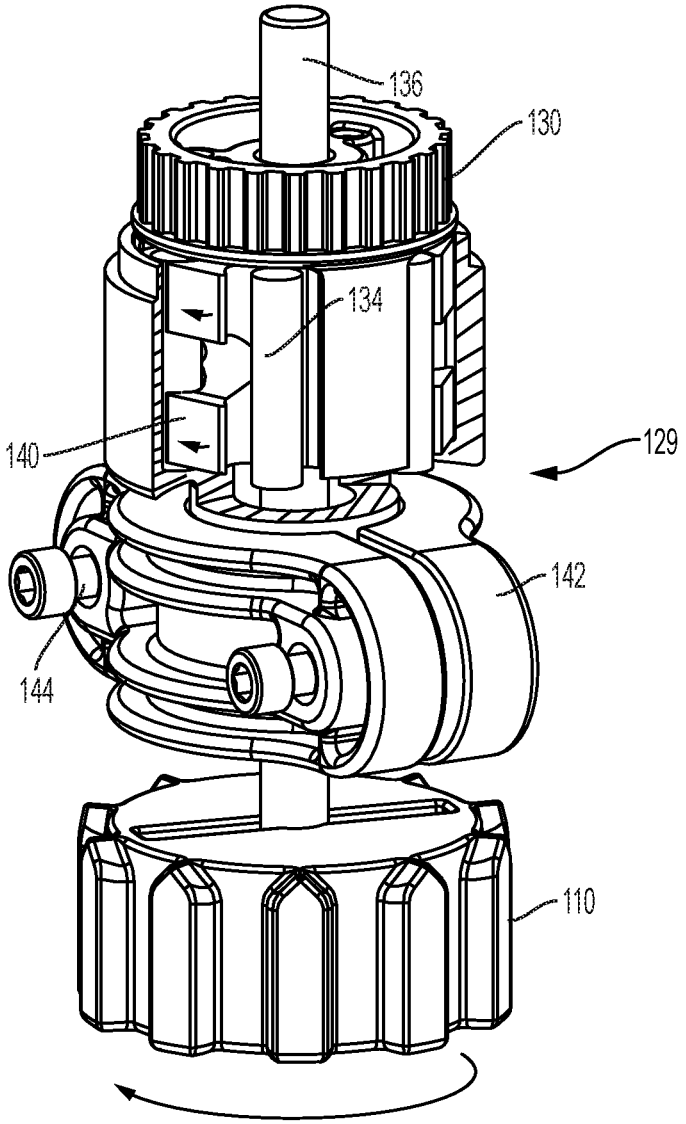
FIG. 60 is an isometric view of the clutch indicating the rotational force on the pinion gear, showing the pinion gear as it rotates, rotating the trilobe.
Figure 61:
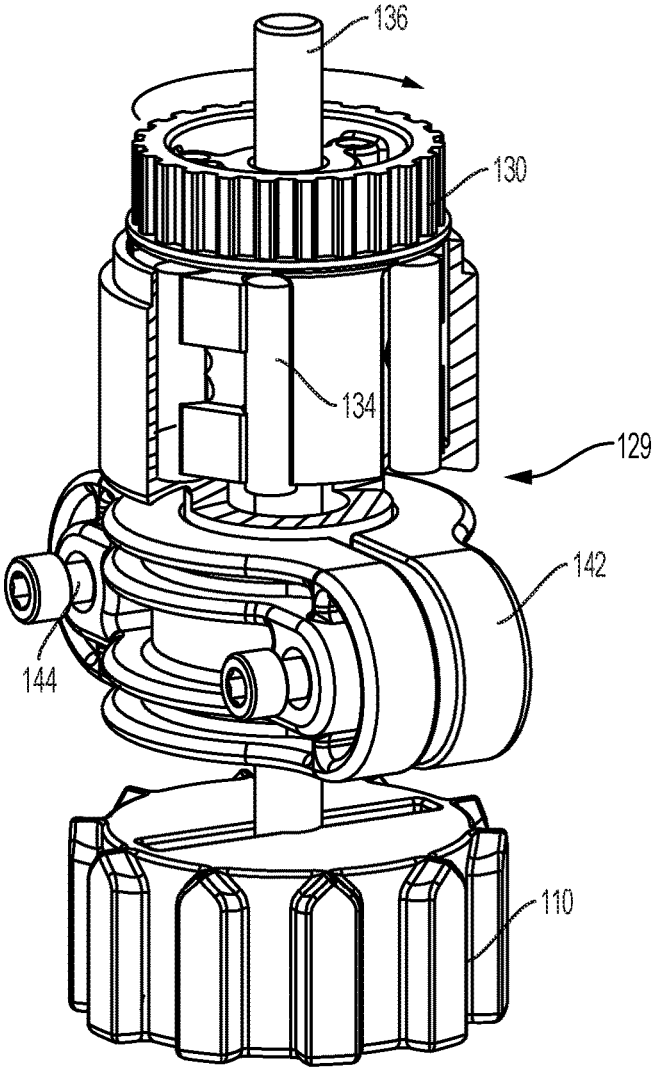
FIG. 61 shows input force on the toothed drum rotating the tines inside the clutch, pressing the roller bearings away from the clutch sleeve, unlocking the clutch.
Figure 62:
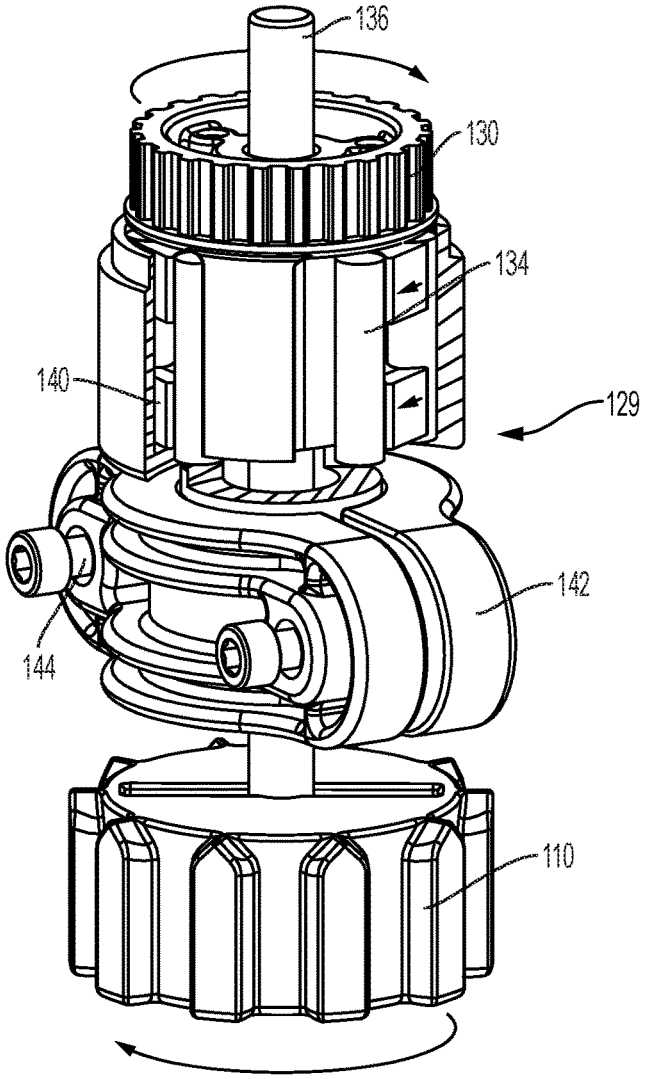
FIG. 62 shows the tines of the toothed drum pressing the roller bearings into the trilobe in turn rotating the drive.

FIGS. 56 and 60 indicate, by arrows, the rotational force on the pinion gear 110 showing the pinion gear as it rotates, rotating the trilobe 140, the cam surface 135 on the trilobe pressing three of the roller bearings 134 into the inner wall 137 of the clutch sleeve 138, locking the clutch. If the pinion gear 110 were to be forced in the other direction, the other three roller bearings would lock between the trilobe 140 and the inner wall 137 of clutch sleeve 138.

Clutch Overide Bracket—The above described elements of the clutch are held in clutch override bracket 142 which is secured by bolts 144. The clutch override bracket 142 attaches the clutch sleeve 138 to the well 20. It clamps around a smaller cylindrical section of the clutch sleeve 138. This clamping force can be adjusted to create a specific amount of holding force. If the drive is over powered, to avoid any mechanical failure in the clutch, the clutch sleeve 138 will slip in the clutch override bracket 142, allowing the drive and steering handle 104 to turn.

Figure 63:
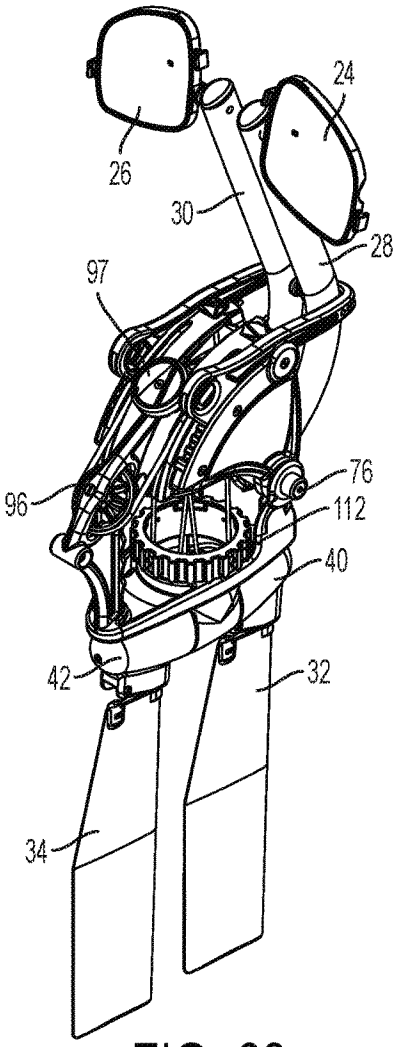
FIG. 63 is a perspective view of the propulsion system of another embodiment of the invention taken from the right rear.
Figure 64:
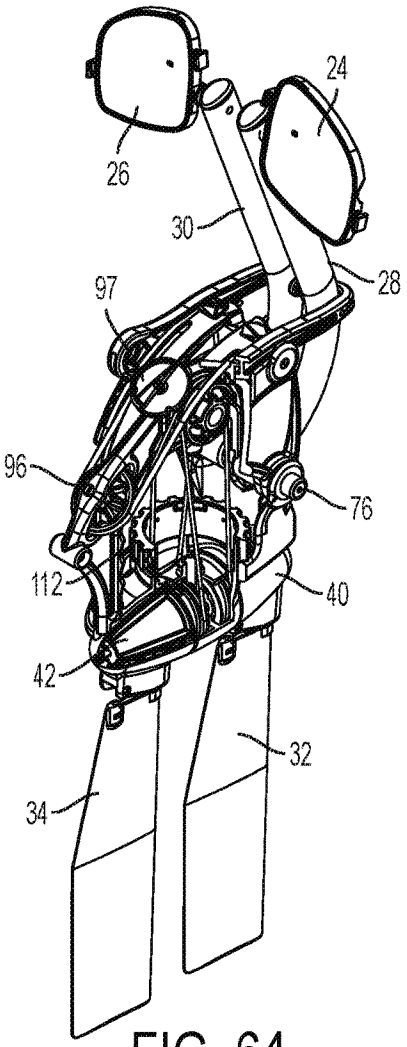
FIG. 64 is similar to FIG. 63 with additional parts broken away.
Figure 65:
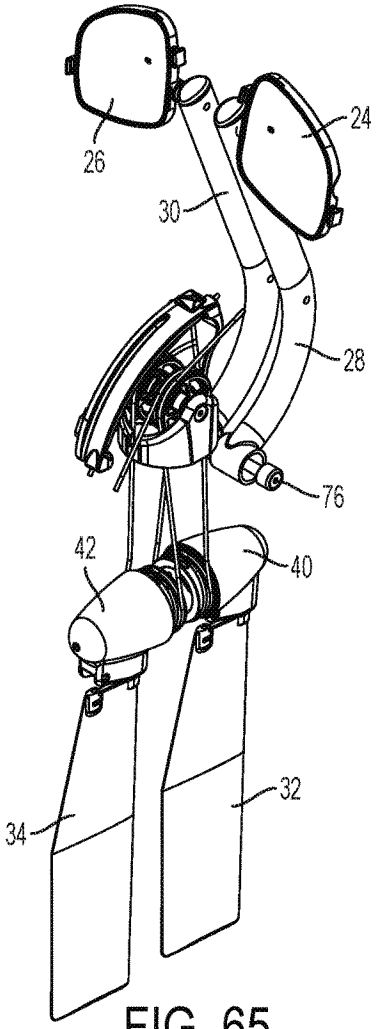
FIG. 65 is similar to FIG. 64 with still more parts broken away.

Turning to FIGS. 63 to 65, there another embodiment of the invention is shown. In this embodiment, the two bearing ring assemblies are not present and, hence, the vertical axis 90 about which the drums with fins are continuously rotatable is limited to about 90° to the left and right. While less preferred, this embodiment does afford the user a wide choice in change of direction using the above-described steering mechanism.

Figure 51:
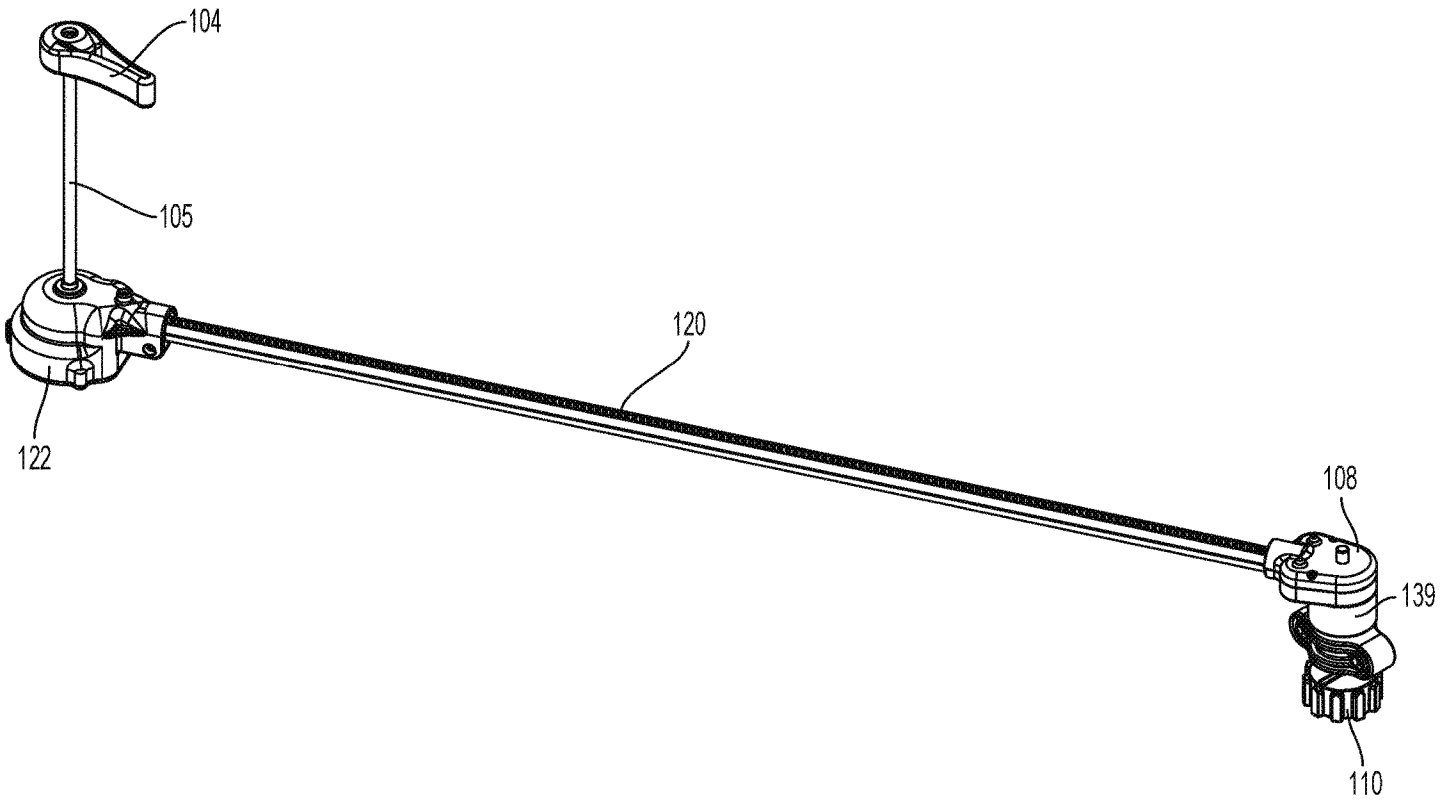
FIG. 51 shows the toothed belt connecting the steering system to the clutch, the compression tube enclosing the belt being removed.
Figure 52:
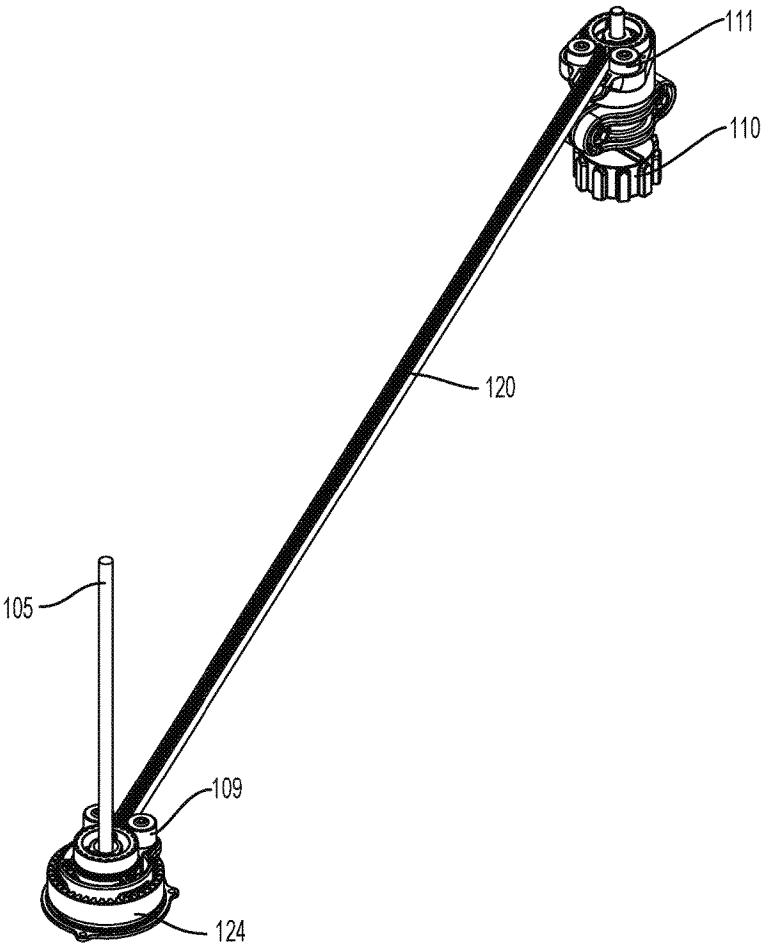
FIG. 52 is similar to FIG. 51 with parts removed at the steering system and the clutch.

The manually operated steering system shown in detail in FIG. 54 can be replaced by an electronic system to operate the drive belt 120 of FIGS. 51 and 52. Alternatively, the manually operated steering system can be coupled with an electrically powered assist to decrease the input load required of the user to steer.

Figure 66:
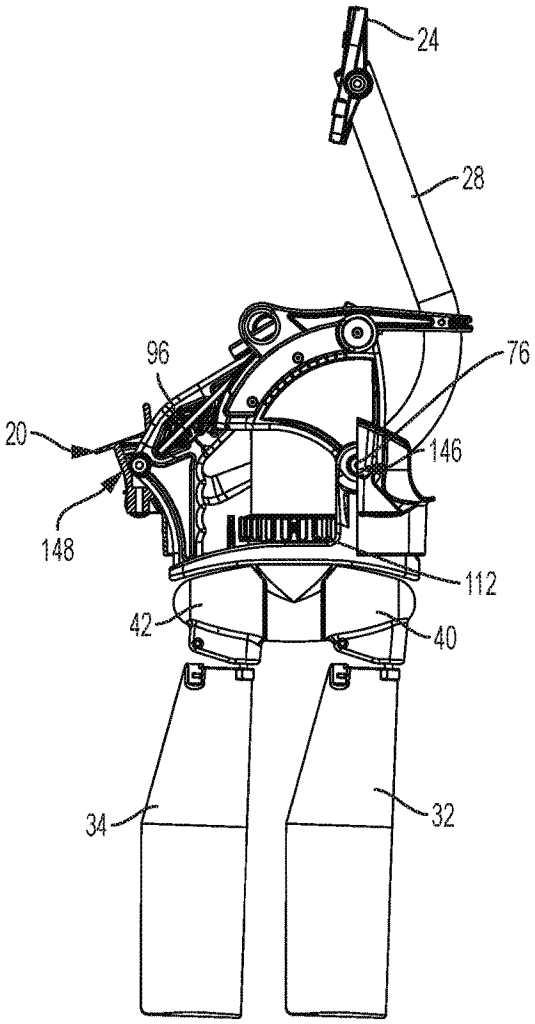
FIG. 66 is a side view with parts removed showing how the propulsion mechanism is supported in the well opening in the bottom of the watercraft.

Turning to FIG. 66, this view shows that the propulsion mechanism is supported at its forward extremity at an area 146 in well 20 and at its rear at area 148.

What is claimed:

1. A propulsion mechanism adapted to be inserted in an opening in the bottom of a watercraft comprising a pair of flexible fins extending below the water line, said pair of flexible fins each adapted to oscillate through an arcuate path on a horizontal shaft to propel the watercraft, said horizontal shaft being continuously rotatable in either direction about a generally vertical shaft to propel said watercraft in any direction in a generally horizontal plane, whereby as input force is applied to said pair of flexible fins, said pair of flexible fins can twist to form an angle of attack for providing thrust while moving in both directions along said arcuate path.

2. The propulsion mechanism of claim 1 wherein upper cables couple each of said pedals to bearing ring assemblies, each bearing ring assembly comprising an upper non-rotatable ring and a lower rotatable ring, said upper cables being coupled to said upper rings, and lower cables coupling said lower rings to said horizontal shaft to oscillate said fins, said lower cables and bearing ring assemblies reciprocating in alignment with said vertical shaft by input force to said pedals, one bearing ring assembly passing freely through said other bearing ring assembly.

3. The propulsion mechanism of claim 2 wherein each pedal operates two cables, one cable coupling to one said upper non-rotatable ring and the other cable coupling to the other said upper non-rotatable ring, and two lower cables coupling one said lower rotatable ring to said horizontal shaft, and two lower cables coupling said other lower rotatable ring to said horizontal shaft.

4. The mechanism of claim 3 wherein said horizontal shaft comprises a horizontal shaft carrying two drums oscillatable on said shaft, each drum carrying one of said fins, two of said lower cables attached to opposed sides of each of said drums.

5. A watercraft comprising a propulsion mechanism extending through an opening in the bottom of the watercraft, said propulsion mechanism comprising a pair of flexible fins extending below the water line, said pair of flexible fins each adapted to oscillate through an arcuate path on a horizontal shaft to propel the watercraft, said horizontal shaft being continuously rotatable in either direction about a generally vertical shaft to propel said watercraft in any direction in a generally horizontal plane, whereby as input force is applied to said pair of flexible fins, said pair of flexible fins can twist to form an angle of attack for providing thrust while moving in both directions along said arcuate path.

6. The watercraft of claim 5 having a cockpit, a steering handle adjacent said cockpit operable by an occupant of said cockpit, said steering handle being coupled to said vertical shaft to rotate said horizontal shaft.

7. The watercraft of claim 5 wherein the watercraft is a kayak.

8. The watercraft of claim 6 wherein a direction indicator is disposed so as to be visible from said cockpit, said direction indicator is coupled to said vertical shaft.

9. A propulsion mechanism adapted to be inserted in an opening in the bottom of a watercraft comprising a pair of flexible fins extending below the water line, said pair of flexible fins each adapted to oscillate through an arcuate path on a horizontal shaft to propel the watercraft, said horizontal shaft being continuously rotatable in either direction about a generally vertical shaft to propel said watercraft in any direction in a generally horizontal plane, and a pair of pedals coupled to said pair of flexible fins for applying input force whereby as input force is applied, said pair of flexible fins can twist to form an angle of attack for providing thrust while moving in both directions along said arcuate path.

10. A watercraft comprising a propulsion mechanism extending through an opening in the bottom of the watercraft, said propulsion mechanism comprising a pair of flexible fins extending below the water line, said pair of flexible fins each adapted to oscillate through an arcuate path on a horizontal shaft to propel the watercraft, said horizontal shaft being continuously rotatable in either direction in a generally horizontal plane about a generally vertical shaft to propel said watercraft in any direction, and a pair of pedals coupled to said pair of flexible fins for applying input force whereby as input force is applied, said pair of flexible fins can twist to form an angle of attack for providing thrust while moving in both directions along said arcuate path.

11. A propulsion mechanism adapted to be inserted in an opening in the bottom of a watercraft comprising a pair of flexible fins extending below the water line, said pair of flexible fins each adapted to oscillate through an arcuate path on a horizontal shaft to propel the watercraft, said horizontal shaft being continuously rotatable in either direction about a generally vertical shaft to propel said watercraft in any direction in a generally horizontal plane, said vertical shaft being remotely controlled from within the watercraft to steer the watercraft in any direction while being pedaled, and a pair of pedals coupled to said pair of flexible fins for applying input force whereby as input force is applied, the pair of flexible fins can twist to form an angle of attack for providing thrust while moving in both directions along the arcuate path.

12. A watercraft comprising a propulsion mechanism extending through an opening in the bottom of the watercraft, said propulsion mechanism comprising a pair of flexible fins extending below the water line, said pair of flexible fins each adapted to oscillate through an arcuate path on a horizontal shaft to propel the watercraft, said horizontal shaft being continuously rotatable in either direction about a generally vertical shaft to propel said watercraft in any direction in a generally horizontal plane, said vertical shaft being remotely controlled by elements operable from within the watercraft to steer the watercraft in any direction while being pedaled, and a pair of pedals coupled to said pair of flexible fins for applying input force whereby as input force is applied, said pair of flexible fins can twist to form an angle of attack for providing thrust while moving in both directions along the arcuate path.

13. A watercraft comprising a propulsion mechanism extending through an opening in the bottom of the watercraft, said propulsion mechanism adapted to rotate about a generally vertical shaft and being steered from within the watercraft to rotate said propulsion mechanism in any direction in a generally horizontal plane, a clutch coupled to said vertical shaft operable to lock said vertical shaft in position to resist rotational torque and to allow rotation when actively steered from within said watercraft, and a pair of pedals coupled to the propulsion mechanism for applying input force whereby as input force is applied thrust is produced.

14. The watercraft of claim 13 wherein said pair of pedals are coupled to a pair of flexible fins whereby as input force is applied, said pair of flexible fins can twist to form an angle of attack for providing thrust while moving in both directions across an arcuate path.

15. The watercraft of claim 14 wherein said pair of pedals are operatively coupled with a pair of flexible fins for applying input force wherein as input force is applied, said pair of flexible fins can twist to form an angle of attack for providing thrust while moving in both directions across an arcuate path and said clutch being attached to said watercraft and adapted to slip in the event said pair of flexible fins are over-forced.

16. A propulsion mechanism adapted to be inserted in an opening in the bottom of a watercraft comprising a pair of flexible fins extending below the water line, said pair of flexible fins each adapted to oscillate through an arcuate path on a horizontal shaft to propel the watercraft, said horizontal shaft being continuously rotatable through about 90° left and right about a generally vertical shaft to propel said watercraft in any direction in a generally horizontal plane, whereby as input force is applied to said pair of flexible fins, said pair of flexible fins can twist to form an angle of attack for providing thrust while moving in both directions along said arcuate path.

17. A watercraft comprising a propulsion system extending through an opening in the bottom of said watercraft, said propulsion mechanism comprising a pair of flexible fins extending below the water line, said pair of flexible fins each adapted to oscillate through an arcuate path on a horizontal shaft to propel the watercraft, said horizontal shaft being continuously rotatable through about 90° left and right about a generally vertical shaft to propel said watercraft in any direction in a generally horizontal plane, whereby as input force is applied to said pair of flexible fins, said pair of flexible fins can twist to form an angle of attack for providing thrust while moving in both directions along said arcuate path.

* * * * *